US011965662B2

(12) United States Patent
Vakiloroaya

(10) Patent No.: US 11,965,662 B2
(45) Date of Patent: Apr. 23, 2024

(54) AIR CONDITIONING SYSTEM

(71) Applicant: HVPS Holdings (PTY) Limited, Melbourne (AU)

(72) Inventor: Vahid Vakiloroaya, New South Wales (AU)

(73) Assignee: HVPS Holdings (PTY) Limited, Victoria (AU)

( * ) Notice: Subject to any disclaimer, the term of this patent is extended or adjusted under 35 U.S.C. 154(b) by 184 days.

(21) Appl. No.: 16/089,504

(22) PCT Filed: Mar. 31, 2017

(86) PCT No.: PCT/AU2017/050279

§ 371 (c)(1),
(2) Date: Sep. 28, 2018

(87) PCT Pub. No.: WO2017/165924

PCT Pub. Date: Oct. 5, 2017

(65) Prior Publication Data

US 2023/0332778 A1 Oct. 19, 2023

(30) Foreign Application Priority Data

Apr. 1, 2016 (AU) ..... 2016901211

(51) Int. Cl.
*F24F 1/42* (2011.01)
*F24F 13/22* (2006.01)
(Continued)

(52) U.S. Cl.
CPC ..... *F24F 1/42* (2013.01); *F24F 13/222* (2013.01); *F28D 1/0426* (2013.01);
(Continued)

(58) Field of Classification Search
CPC .. F24F 1/42; F24F 13/222; F24F 13/30; F24F 2013/227; F28F 9/0234; F28F 17/005
See application file for complete search history.

(56) References Cited

U.S. PATENT DOCUMENTS 4,067,205 A 1/1978 Mayhue
6,189,334 B1 * 2/2001 Dienhart ..... F25B 39/04 62/509

(Continued)

FOREIGN PATENT DOCUMENTS

CN 202853082 U 4/2013
CN 103670648 A 3/2014

(Continued)

OTHER PUBLICATIONS

Chinse Office Action issued in Application No. 201780034068.3, dated Mar. 26, 2021, 10 pgs.

(Continued)

*Primary Examiner* — Eric S Ruppert
*Assistant Examiner* — Hans R Weiland
(74) *Attorney, Agent, or Firm* — Woodard. Emhardt, Henry, Reeves & Wagner, LLP

(57) ABSTRACT

The present invention relates to a heat exchanger arrangement for use with an air conditioning system of the type comprising a condenser, an expansion device, an evaporator and a compressor connected in a refrigeration circuit filled with refrigerant. The heat exchanger arrangement comprises a collector arrangement for collecting condensate fluid that has condensed on the evaporator as condensate fluid. The heat exchanger arrangement also comprises a first heat exchanger configured for facilitating the transfer of heat from an airflow flowing to the condenser, to condensate received from the evaporator.

20 Claims, 11 Drawing Sheets

(51) Int. Cl.

| | |
|---|---|
| ***F24F 13/30*** | (2006.01) |
| ***F28D 1/04*** | (2006.01) |
| ***F28F 17/00*** | (2006.01) |
| *F28F 9/02* | (2006.01) |

(52) U.S. Cl.
CPC ..... *F28D 1/0461* (2013.01); *F28F 17/005* (2013.01); *F24F 2013/227* (2013.01); *F24F 13/30* (2013.01); *F28F 9/0234* (2013.01)

(56) References Cited

U.S. PATENT DOCUMENTS

| | | | | |
|---|---|---|---|---|
| 2005/0028545 | A1 | 2/2005 | Hebert | |
| 2005/0166614 | A1* | 8/2005 | Dobmeier | F25D 21/14 62/150 |
| 2006/0101838 | A1 | 5/2006 | Ritchey | |
| 2013/0061615 | A1* | 3/2013 | Omer | F24F 13/222 62/277 |
| 2014/0360703 | A1* | 12/2014 | Kim | F28D 9/0043 165/140 |
| 2015/0362230 | A1* | 12/2015 | Al-Farayedhi | F25D 17/00 62/291 |
| 2016/0311311 | A1* | 10/2016 | Choi | B60K 11/04 |
| 2017/0067672 | A1* | 3/2017 | Vakiloroaya | F24H 4/02 |

FOREIGN PATENT DOCUMENTS

| | | | |
|---|---|---|---|
| EP | 1121565 | B1 | 10/1999 |
| FR | 2552862 | A1 | 4/1985 |
| JP | 2012-101167 | | 5/2012 |
| JP | 2013-155949 | | 8/2013 |
| WO | WO 2015/164919 | A1 | 11/2015 |

OTHER PUBLICATIONS

European Search Report issued in U.S. Appl. No. 17/772,882, dated Oct. 25, 2019, 1 pg.
Chinese Office Action issued in Application No. 201780034068.3, dated May 7, 2021, 7 pgs.
Office Action in related JP2018-551949 dated May 18, 2021.
Australian Search Report issued in Application No. 2016901211, dated Dec. 22, 2016, 14 pgs.
International Search Report and Written Opinion issued in PCT/AU2017/050279, dated Jun. 1, 2017, 8 pgs.

* cited by examiner

AIR CONDITIONING SYSTEM

CROSS-REFERENCE

The present application claims priority from Australian provisional patent application 2016901211 filed on 1 Apr. 2016, the entire disclosure of which should be understood to be incorporated by reference into this specification.

TECHNICAL FIELD

The present invention relates to cooling, heating, refrigeration, air conditioning and in particular to an improved air-conditioning system. The invention has been developed primarily for use in/with an air-conditioning and/or refrigeration system and will be described hereinafter with reference to this application. However, it will be appreciated that the invention is not limited to this particular field of use.

BACKGROUND OF INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

Air-conditioning systems are a major contributor to summer peak electrical demands. They lead to the reduction of the valuable fossil fuel sources while contributing to the very problem of greenhouse gas emission that depletes the ozone layer leading to dire health consequences. Global warming is another major problem attributed by conventional heating, ventilation, and air conditioning (HVAC) systems that increase the average temperature world-wide. HVAC systems typically account for around 40% of total electricity consumption of buildings. Air-conditioning units are least efficient at high ambient temperatures when cooling demand is highest. This leads to increased pollution, excessive investment in standby generation capacity, and poor utilization of peaking assets. The overall attainable reduction in energy consumption and enhancement of human comfort in the buildings are therefore dependent on the performance of HVAC systems. In view of the above, there have been continued attempts to increase the efficiency of air-conditioning systems.

The air-conditioning cycle involves a number thermodynamic and mechanical operations, many of which have been the subject of previous efforts to improve overall process efficiency. Previous efforts have, for example, been directed toward provided improved chemical refrigerants. Other previous efforts have focused on improving efficiency at one of the four transition stages of the air-conditioning refrigerant (compression, condensation, expansion, evaporation). By way of example, improvements in electric motor technology have produced improvements at the compression stage of the air-conditioning process whereas the provision of inverter fans in outdoor condenser units were focused on improved efficiency at the condensation stage of the cycle.

A particular area of development has been the use of liquid condensate collected from the evaporator as a cooling agent within the air-conditioning cycle. Once such example is provided in patent document FR 2552862. This document discloses the collection and storage of condensate in a condensate tank through which a portion of the refrigerant piping between the compressor and condenser is diverted so as to pre-cool the refrigerant prior to entering the condenser. Another example of a refrigerant line pre-cooler is provided in US 20050028545. This system involves locating the pre-cooler in the exhaust of a building's air supply permitting evaporative cooling of the refrigerant line which is wetted by condensate from the evaporator (or another water supply).

A further example of using condensate to cool the refrigerant line is provided in the Applicant's previous publication WO2015164919 which provided, inter alia, an improvement in the execution of the concept disclosed in FR 2552862. In particular WO2015164919 provided a pair of cooperating heat exchangers in which a first heat exchanger transfers heat away from the refrigerant to a reservoir of liquid condensate reservoir collected from the evaporator. A second heat exchanger is provided downstream of the condenser fan airflow facilitating heat transfer away from the condensate to the ambient air via the condenser fan airflow. This arrangement therefore delays or reduces warming of the condensate so as to extend the period in which the condensate temperature is low enough to provide useful cooling of the refrigerant line.

It will be appreciated that, in the above prior systems, evaporator condensate has been used exclusively to cool the refrigerant line. In alternative prior systems, efforts have been made to further utilise condensate after it receives heat from the refrigerant line.

Once such example is provided in US20130061615 in which condensate is utilised in a first heat transfer process to cool the refrigerant line via a 'sub-cooler' located between the condenser and expansion valve. After emerging from the sub-cooler, the condensate is utilised in a second heat transfer process whereby the warmed condensate is pumped into a manifold and sprayed onto the air flow entering the condenser. The second heat transfer process is directed at cooling (and therefore improving the efficiency of) the condenser however this arrangement suffers from a number of drawbacks. In particular, the arrangement requires condensate to be moved under the influence of a pump which requires electrical input to operate and also adds heat to the condensate thereby decaying the improvement provided by the second heat transfer process. The efficacy of the second heat transfer process is also limited in that the condensate sprayed on the condenser has already been warmed by the first heat transfer process in the sub-cooler. Furthermore, the spraying of misted condensate onto the condenser coil is generally undesirable in terms of corrosion promotion.

Another previous example of condensate utilisation (other than cooling of the refrigerant line) is provided in US 2015/0362230 which sought to combine a number of condensate-utilising cooling arrangements in a single system. In particular, this publication discloses liquid condensate being collected from the evaporator into a storage tank. Condensate is then mechanically circulated through three separate heat exchanging systems before and directed back to the condensate tank for continued recirculation through the three systems. The three heat exchanging systems include a first pre-cooler for cooling airflow upstream of the evaporator, a second pre-cooler for cooling airflow blown onto the condenser and, thirdly, a sub-cooler for cooling the refrigerant line between the condenser and expansion valve.

As with the previously discussed prior arrangement, the system described in US 2015/0362230 suffers from the drawback of requiring an electric pump as an essential element to drive coolant through the various conduits, valves and heat exchangers. The use of an electric pump increases electricity usage and undesirably adds additional heat to the cold condensate. Another drawback is that continued recirculation of the condensate through the three cooling systems progressively increases condensate temperature in the storage tank thereby reducing system efficacy. A further drawback is the overall complexity of the system. For example, control valves are required in order to direct condensate toward a particular cooling system (compensating for the tendency of condensate to travel the path of least resistance). The complexity of the system is also likely to reduce reliability given the relatively high number of heat exchangers and moving components such as the pump and numerous valves. Complex systems such as that disclosed in US2015/0362230 are also likely to increase initial cost thereby requiring an undesirably longer 'break even' period of operation before the improvements in efficiency (if any) offset the added cost over a conventional air-conditioner system.

In light of the above, it would therefore be desirable to provide an improved or alternative heat exchanger arrangement or air-conditioner system.

SUMMARY OF INVENTION

According to the present invention there is provided a heat exchanger arrangement for use with an air conditioning system comprising a condenser, an expansion device, an evaporator and a compressor connected in a refrigeration circuit filled with refrigerant, the heat exchanger arrangement comprising: a collector arrangement for collecting condensate fluid that has condensed on the evaporator as condensate fluid; and a first heat exchanger, the first heat exchanger being configured for facilitating the transfer of heat from an airflow flowing to the condenser, to condensate received from the evaporator wherein the heat exchanger arrangement comprises a second heat exchanger configured for facilitating the transfer of heat from refrigerant to condensate received from the evaporator and wherein the second heat exchanger is located within a container associated with, and located at an upper portion of the first heat exchanger.

In contrast with previous systems which have typically focused on using condensate to cool refrigerant, the present invention advantageously utilises condensate collected from the evaporator to cool an airflow flowing to the condenser. Ambient air temperature blown onto an air conditioner's condenser can vary significantly and, on warm days, can result in a significant reduction to system efficiency. As will be readily appreciated, the function of the condenser is to cool high-pressure gas exiting the compressor so as to convert the high-pressure gas into a high-pressure liquid. During warm days (when air conditioning is most desired) ambient air temperature blowing onto the outdoor unit housing the condenser can rise to 30° C. or greater. The rise in ambient temperature significantly reduces the condenser's ability to sufficiently cool the high-pressure gas refrigerant. Reduced condenser efficiency results in a higher temperature refrigerant exiting the condenser and a reduction in cooling potential from the working fluid (i.e. the refrigerant). Accordingly, cooling the airflow flowing toward the condenser provides an improvement in system efficiency.

The present invention advantageously applies this concept by utilising condensate collected from the evaporator to reduce the temperature of the airflow blowing onto the condenser in a first heat exchanger. In contrast, prior art systems such as those disclosed in WO2015164919, FR 2552862 and US 20050028545 are concerned with cooling the refrigerant and not the condenser airflow temperature.

Whilst the previous systems disclosed in US2015/0362230 and US20130061615 generally disclose condenser-cooling using collected condensate, the condenser-cooling components of each prior system are used in conjunction with one or more other cooling systems therefore significantly reducing the effectiveness of the prior art condenser-coolers. In particular, the prior condenser-cooling systems rely on condensate which is already too warm to provide a desirable improvement in efficiency. The system disclosed in US2015/0362230 splits the limited supply of condensate between various cooling systems thereby reducing the volume of condensate provided to the condenser-cooling system. The system in US20130061615 supplies condensate to a condenser-cooling system only after the condensate flow has exited a refrigerant-line cooling system thereby reducing the condensate cooling potential prior to its use as a condenser-coolant.

As noted above, an increase in ambient temperature (usually corresponding with an increased user demand for air conditioning) results in higher temperature ambient air being blown onto the condenser and therefore a reduction in condenser efficiency. The air flow cooling provided by first heat exchanger of the present invention will therefore typically become more advantageous with an increase in ambient air temperature and the energy savings provided by the present invention will generally increase on hotter days. Similarly, greater ambient humidity will generally increase the volume of condensate collected from the evaporator and consequentially the volume of coolant provided to the first heat exchanger. Accordingly, the energy savings provided by the present invention will also generally increase on more humid days.

According to a particular embodiment of the invention, the collector arrangement, the first heat exchanger and a coolant outlet are connected in fluid communication via a coolant pathway, the coolant outlet being located downstream of the first heat exchanger in the coolant pathway for, in use, expelling waste coolant that has received heat from the first heat exchanger. This embodiment of the invention advantageously permits the expulsion of waste coolant after cooling properties have been expended. In contrast to some existing systems which seek to recirculate all or substantially all of the condensate collected from the evaporator, the provision of a coolant outlet downstream of the first heat exchanger facilitates the provision of primarily 'fresh' coolant to the first heat exchanger i.e. coolant which is yet to receive heat from the first heat exchanger. This form of the present invention represents a significant improvement over prior devices which continually recirculate ever warming condensate. In such systems, cooling effectiveness reduces with each recirculation until condensate is heated to the substantially the same temperature as the heat exchanger (at which point cooling effectiveness reaches zero).

It will be appreciated that references herein to 'coolant' will include condensate collected from the evaporator and in some cases the coolant within the coolant path will be comprised of entirely liquid condensate. In other instances (such as in low humidity environments where the amount of condensate collected from the evaporator is low) it may be desirable to supplement the liquid condensate with an external water supply in which case the coolant associated with the present invention can be a combination of liquid condensate and supplementary or 'top up' water.

As noted above, it may be generally desirable that the first heat exchanger is supplied with entirely 'fresh' condensate received directly from the collector arrangement i.e. condensate which has not already passed through the first heat exchanger. Accordingly, in particular forms of the invention, the coolant pathway comprises an open-loop configuration whereby no portion of the condensate flow is recirculated through the first heat exchanger. Open-loop forms of coolant pathway are desirable insofar as all of the condensate supplied to the first heat exchanger is provided at maximum cooling potential (i.e. as cold as possible). In turn, the first heat exchanger is able to provide the best possible cooling effect on the airflow into the condenser.

However, in alternative forms of the invention, the coolant pathway may be adapted to recirculate a relatively small portion of condensate so as to supplement the fresh condensate collected from the evaporator. Accordingly, in a particular form of the invention, the coolant pathway includes a recirculation loop extending from an inlet downstream of the first heat exchanger to an outlet upstream of the first heat exchanger and whereby, in use, a portion of the condensate supplied to the first heat exchanger is recirculated condensate supplied through the recirculation loop.

It will be appreciated that this form of the invention still represents an improvement over existing systems which recirculate most or all of the condensate and which generally do not expel any condensate after cooling potential has been expended. The precise amount of condensate which can be recirculated before substantial reductions in efficiency are observed will vary depending on a variety of factors such as geographical location, underlying air conditioner efficiency and day-to-day temperature. However, in a particular embodiment of the invention, the portion of recirculated condensate supplied to the first heat exchanger is less than 50% of the total volumetric flow of condensate supplied to the first heat exchanger. In a more particular form of the invention, the portion is recirculated condensate is less than 40%, more particularly less than 30% and even more particularly less than 20% of the total volumetric flow of condensate supplied to the first heat exchanger. In a particular embodiment of the invention, the portion of recirculated condensate supplied to the first heat exchanger is less than 10% and more particularly less than 5% of the total volumetric flow of condensate supplied to the first heat exchanger.

In a particular form of the invention, the coolant pathway is configured to deliver substantially all condensate collected by the collector arrangement to the first heat exchanger. This form of the invention provides a significant advantage over prior systems such as that disclosed in US2015/0362230 where the condensate supply is split between three separate cooling circuits. The coolant pathway can also be configured such that the first heat exchanger is directly downstream of the collector arrangement i.e. the coolant does not enter any other heat transfer devices before entering the first heat exchanger. In this regard, the maximum cooling potential of the liquid condensate may be provided to the first heat exchanger.

As noted in the foregoing, prior art devices undesirably utilise condensate in other heat exchangers, for example, refrigerant-cooling heat exchangers before using the condensate for condenser airflow cooling purposes. In these systems, the temperature of the condensate is therefore significantly increased before entering the condenser-cooling portion of the system. Advantageously, the coolant pathway of the present invention can be generally configured to minimise condensate temperature increase between the collector arrangement and the first heat exchanger. The coolant path may therefore deliver condensate to the first heat exchanger with minimal at a temperature approximately equal to or only slightly greater than the temperature at which the condensate is collected in the collector arrangement. By way of example, the coolant pathway can be configured such that the first heat exchanger is immediately downstream of the collector arrangement. That is, no intermediary heat exchangers are positioned between the collector arrangement and the condenser-cooling heat exchanger (i.e. the first heat exchanger).

It will be appreciated that some heating of the condensate may occur during the transfer from collector arrangement to the first heat exchanger however this warming is typically minor as compared to previous systems which located hot refrigerant cooling processes between the collector arrangements and the condenser airflow cooler. The term 'directly downstream' is to be interpreted as referring to the condensate being directed to the first heat exchanger without passing through intermediary devices. The present invention can therefore be configured so as to avoid the condensate undergoing any significant or deliberate heating processes between the collector and first heat exchanger. A condensate conduit connecting the collector arrangement and the first heat exchanger can also be provided with appropriate insulation to maintain the cool condensate temperature insofar as possible.

As noted above, the present invention is advantageous in that it is directed to a heat exchanger arrangement whereby the cooling potential of condensate is expended primarily on cooling the airflow toward the condenser. Condensate exiting the first heat exchanger arrangement which has received heat from the airflow into the condenser may, in some embodiments of the invention, be expelled as waste through the coolant outlet or, alternatively, a portion may be recirculated via a recirculation loop for a second pass through the first heat exchanger. It will be appreciated that, due to inherent efficiency limitations in heat exchangers, the coolant exiting the first heat exchanger will be warmed but will typically still be at a temperature less than the ambient air temperature and will generally be cooler than refrigerant temperature.

Accordingly, in a particular form of the invention the heat exchanger arrangement comprises a second heat exchanger configured for facilitating the transfer of heat from refrigerant to condensate received from the evaporator. The second heat exchanger can operate to supplement the air conditioner efficiency improvements provided by the first heat exchanger. However, unlike prior systems, the heat exchanger arrangement of the present invention does not compromise on condenser-cooling by splitting the supply of fresh condensate between a condenser air-cooler and a refrigerant cooler or by supplying the condenser-cooler with (warmed) coolant emitted from a refrigerant cooler.

In this regard, the heat exchanger arrangement of the present invention can advantageously be configured for guiding the flow of fluid from the first heat exchanger to the second heat exchanger. That is, the second heat exchanger is supplied with condensate which has first passed through the first heat exchanger and not the other way around as provided in prior art systems such as US20130061615. In this embodiment, the second heat exchanger can be connected to the coolant pathway downstream of the first heat exchanger and upstream of the coolant outlet.

Previous systems disclosed in US2015/0362230 and US20130061615 generally disclose condenser-cooling using collected condensate however the condenser-cooling systems are arranged in such a way that condensate has already been warmed to the point that condenser-cooling potential is low or provides no functional cooling. This is due to the fundamental thermodynamic principles governing air conditioner operation. In particular, the function of the condenser is to transfer heat from the hot refrigerant to the cooler ambient air. The heat exchange within the condenser never ideal (i.e. does not achieve full exchange) and therefore refrigerant exiting the condenser will still be at a temperature higher than the ambient air. Cool liquid condensate collected from an evaporator is typically between 10-20° C. and will be lower than both the refrigerant temperature and the ambient temperature however the temperature differential between the condensate and ambient temperature is smaller than the temperature differential between the condensate and refrigerant.

The present invention advantageously recognises and utilises this principle by directing the condensate to the first heat exchanger before the second heat exchanger. Whilst the temperature of the liquid condensate is suitable for cooling either (or both) the refrigerant or the ambient air blowing onto the condenser, it will be appreciated that thermal transfer (i.e. thermal flux) is proportionate to difference in temperature between a coolant and the heated medium desired for cooling. Accordingly, in order to cool the ambient air which is of lower temperature than the refrigerant, it is necessary for the condensate to be as cool as possible. If condensate is first used to cool the hot refrigerant line the condensate will typically have been warmed to a temperature close or equal to the temperature of the ambient air which therefore eliminates or severely reduces the condenser-cooling potential of the condensate.

By way of example, the present invention may supply a condensate of 12° C. to the first heat exchanger in order to cool an ambient air temperature of 25° C. After cooling the ambient air, the condensate temperature may, for example, have risen from 12° C. to 17° C. At this point, the condensate is still cool enough to cool refrigerant exiting the condenser (typically 20-50° C.) in the second heat exchanger. In contrast, prior art system US20130061615 uses condensate to first cool the refrigerant exiting the condenser thereby significantly warming the condensate and reducing or eliminating the condensate's ambient air cooling potential. In this regard, the coolant path configuration provided by present invention enables effective cooling of both the ambient air being blown onto the condenser as well as the refrigerant.

Accordingly, coolant collected from the collector arrangement may first be directed to the first heat exchanger so as to utilise the maximum cooling potential of the condensate on the high ambient airflow temperature. Upon exit from the first heat exchanger, the warmed condensate has received heat from the ambient airflow flowing toward the condenser. However, as noted above, the condensate can typically still be at a lower temperature than the refrigerant, and is therefore then utilised in a second heat exchanger where it receives additional heat from the refrigerant line. After receiving heat from the first and second heat exchangers, the liquid condensate is then expelled through the coolant outlet downstream of the second heat exchanger. Expelled condensate may, for example, be directed toward a garden for plant watering purposes or, in alternative embodiments of the invention, may be used to heat a municipal water supply.

Whilst the location of the second heat exchanger is downstream of the first heat exchanger in terms of the coolant pathway, the location of the second heat exchanger can vary in terms of the refrigerant circuit. For example, the second heat exchanger can be located between the compressor and condenser (i.e. downstream of the compressor so as to cool the refrigerant prior to entering the condenser). Alternatively, the second heat exchanger can be located between the condenser and expansion device (i.e. downstream of the condenser so as to cool the refrigerant prior to entering the expansion device).

It will be appreciated that the particular structural arrangement of the first and second heat exchangers may vary and that a variety of heat exchanger designs may be suitable for facilitating heat transfer from the airflow to the liquid condensate (in the first heat exchanger) and from the refrigerant to the liquid condensate (in the second heat exchanger). However, in a particular form of the invention, the second heat exchanger is located within a container associated with, and located at an upper portion of, the first heat exchanger. This particular arrangement is advantageous in that it utilises principles of fluid convection whereby warmer fluid in the first heat exchanger (of lower density) will tend to float upward toward the second heat exchanger.

Said utilisation of convective principles can, in some instances, obviate the need for a mechanical pump. As noted in the foregoing, a mechanical pump can reduce overall efficiency due to electrical requirements and can also introduce additional (undesirable) heat to the coolant. In this regard, the present invention can be configured for operation without moving components such as pumps, valves, switches and the like which can advantageous lead to increased reliability, reduced cost and improved system robustness. As discussed in the foregoing, prior condenser-cooling systems such as US2015/0362230 and US20130061615 each require motors to operate. In contrast, the upright pipe configuration of the first heat exchanger harnesses convective forces which promote flow along the coolant path.

The avoidance of moving parts can, in some embodiments, also be facilitated by the design of the elongate pipes in the first heat exchanger. The dimensional parameters of the elongate pipes involves a compromise between maximising heat transfer and, on the other hand, maximising coolant flow. It will be appreciated that providing the first heat exchanger with a larger number of thinner pipes provides a larger surface area which increases heat transfer. However the provision of thinner pipes can provide a greater constriction to the coolant flow path which requires additional flow pressure to overcome. In embodiments of the present invention where no motorised pump is present, it will be appreciated that coolant flow pressure is primarily induced by the difference in elevation between the collector arrangement and the first heat exchanger. By way of example, where an indoor unit (and collector arrangement) is located at 200 cm above floor level and the outdoor unit (and first heat exchanger) is located at 85 cm above floor level, a static head pressure of 115 cm will be induced which drives condensate flow along the coolant pathway. In order to design a system which does not require a mechanical pump, the present invention can be configured so as not to provide a pressure loss of greater than 115 cm (which could result in the occurrence of backflow up the condensate conduit and undesirable leakage from the indoor air conditioning unit).

In a particular form of the invention, the diameter of the elongate pipes are approximately 0.750 inches and have a wall thickness of 0.02 inches which, in typical conditions, can provide an effective compromise between maximising heat transfer whilst still facilitating coolant flow. As with thinner elongate pipes, it will be appreciated that longer (i.e. taller) elongate pipes will also require an increased supply pressure to drive coolant upwardly through the pipes and out of the coolant outlet. In this regard, both the diameter and length of the copper tubes can be customised so as not to exceed the supplied pressure and to facilitate desired coolant flow along the coolant pathway between the collector arrangement and the coolant outlet and, where possible, to avoid the need for supplementing supply pressure with a motorised pump arrangement. Accordingly, the dimensional parameters of the first heat exchanger pipes may be altered or configured to optimise heat transfer and/or coolant flow however it is to be appreciated that the particular dimensions of the pipes may nonetheless vary.

Whilst a pump-less cooling arrangement was previously provided by the Applicant's previous publication in WO2015164919, coolant flow through a series of upright tubes was promoted by placement of a refrigerant cooler in a lower tank. Coolant entering the lower tank of WO2015164919 was significantly heated by the hot refrigerant causing coolant to rise through the upright tubes. However it will be appreciated that locating a refrigerant cooler in the lower coolant tank would be detrimental to the condenser-cooling function of the present invention. In contrast to the system disclosed in WO2015164919, coolant flow through the present invention cannot be assisted or promoted by heat received from a second heat exchanger located in a lower coolant tank. To overcome this problem, the coolant pathway in present invention can configured to promote pump-less coolant flow in the manner discussed above. For example, configuring the size and height of the elongate pipes such that pressure required to force water to travel from the collector arrangement to the highest point of the heat exchanger arrangement is less than the pressure provided by the gravity-fed condensate supply.

In a more particular embodiment of the heat exchanger arrangement, the first heat exchanger includes a plurality of coolant passageways extending between a pair of coolant tanks comprising a lower coolant tank and an upper coolant tank, wherein the second heat exchanger is located within the upper coolant tank and the heat exchanger arrangement further including a conduit for delivering condensate collected from the evaporator to the lower coolant tank. This embodiment of the invention advantageously provides a coolant pathway whereby 'fresh' coolant is supplied from the collector arrangement to the lower tank and, upon warming during passage through the coolant passageways, natural convective forces urge warm water upward toward the second heat exchanger thereby drawing additional 'fresh' (and cold) condensate from the lower tank. The more buoyant warmed condensate which floats into the upper tank containing the second heat exchanger receives heat for a second time by operation of the second heat exchanger before being expelled through the coolant outlet. It will be appreciated that the plurality of coolant passageways can each be in fluid communication with the pair of coolant tanks such that the lower coolant tank functions as a coolant inlet manifold and the upper tank function as a coolant outlet manifold for the first heat exchanger.

In particular embodiments of the invention the upper coolant tank may be larger than the lower coolant tank so as to accommodate the second heat exchanger located within the upper coolant tank. The lower coolant tank may be comprised of a relatively narrow pipe or tube. In particular embodiments of the invention, the condensate conduit between the collector arrangement and the first heat exchanger may be provided with one or more layers of insulation to reduce undesired warming of the condensate passing therethrough. Similar, the lower coolant tank of the first heat exchanger may also be provided with one or more layers of insulation for the same reason.

It will be appreciated that this particular arrangement provides an operative association between the first and second heat exchangers which facilitates coolant flow through the coolant pathway without the use of a pump (although a pump may still be desirable in particular installations). The coolant passageways of the first heat exchanger may extend in a generally upright orientation to encourage convection-induced flow of coolant from the lower coolant tank, through the coolant passageways, to the upper coolant tank. In this regard, particular embodiments of the present invention may facilitate a gravity-fed coolant flow supplemented by the above-noted convection-induced flow. Said 'pumpless' embodiments of the invention may be particularly suited to installations where the evaporator is located at a higher elevation than the condenser for example where an air conditioner indoor unit is mounted on an upper portion of an inside wall. In this instance, liquid condensate collected from the evaporator can drain under the influence of gravity toward the first heat exchanger.

The coolant tanks of the above-discussed embodiment may be comprised of any suitable liquid-holding container or reservoir. In a particular embodiment of the invention the coolant tanks may comprise a manifold arrangement extending along the edge of a plurality of elongate copper pipes which comprise the coolant passages of the first heat exchanger. In some embodiments, the elongate copper pipes may be straight. In an alternative embodiment, the elongate copper pipes can include a deflected or kinked portion adjacent to the lower tank to space apart the lower coolant tank from a surface of an outdoor air-conditioning unit. This embodiment enables the lower coolant tank to be offset from a plane defined by the upper sections of the elongate pipes. Said offset advantageously allows for a majority of the elongate pipes (i.e. an upper section of the elongate pipes) to be positioned as close to the condenser as possible without resulting in contact between the lower coolant tank and the outdoor unit.

In a particular embodiment of the present invention the coolant passageways comprise a plurality of elongate pipes. The plurality of elongate pipes may be formed from a variety of materials however, in a particular embodiment the plurality of elongate pipes are formed from copper due to its relatively high thermal conductivity. In a more particular embodiment of the present invention the coolant passageways comprise a plurality of elongate pipes which are, in use, arranged generally vertically. It will, however, be appreciated that the particular orientation of the coolant passageways can depend on the angle of the air conditioner unit with which the first heat exchanger is associated. According to a particular embodiment of the invention, the coolant passageways of the first heat exchanger are configured to overlie an airflow inlet on a condenser of an air-conditioning system. The condenser will typically form part of the 'outdoor-unit' of a typical 'split system' air conditioner. Configuring the first heat exchanger so as to overlie or extend across the air inlet of an outdoor unit can advantageously increase heat transfer between the coolant within the first heat exchanger and the airflow flowing into the condenser (typically under the influence of a condenser fan).

In this context, it will be appreciated that the orientation of the coolant passageways of the first heat exchanger may be generally parallel with an intake face of the condenser airflow inlet. In particular units, the intake face of a condenser airflow inlet may define a generally vertical plane in which case the orientation of the coolant passageways may also be vertical. In other instances the intake face of a condenser airflow inlet/intake may be horizontal or angled in which case the passageways of pipes of the first heat exchanger could be similarly horizontal or angled. In any case, it may be generally desirable for the first heat exchanger to extend across the condenser airflow intake face so as to maximise the volume of intake air contacting the cooling surface (i.e. the coolant passageways) of the first heat exchanger.

It will be appreciated that the first heat exchanger can define a cooling surface configured to, in use, overlie the airflow inlet of a condenser. The cooling surface can, for example, be comprised of the outer surfaces of a plurality of elongate pipes which are cooled by condensate flow through an internal passageway in the pipes. In this regard, the first heat exchanger may also be configured to, in use, facilitate flow of liquid coolant across the airflow inlet. That is, the first exchanger may be generally configured to transfer coolant across the face of the airflow inlet (through coolant passageways) so as to expose the maximum volume of air entering the inlet to the coolant. In this context, the term 'across' can refer to flow from one side of the inlet to the other side and not necessary in a lateral direction. As noted above, it may be generally desirable for coolant to flow from a lower tank located adjacent a lower side of the condenser airflow inlet to an upper tank located adjacent an upper side of the condenser airflow inlet. In instances where the coolant passageways of the first heat exchanger are orientated generally upright or vertically, the coolant flow 'across' the inlet face therefore refers to coolant flow from a lower side of the inlet to an upper side of the inlet.

The heat exchanger arrangement of the present invention may include a heat exchanger assembly configured for connection to an existing air conditioner system, for example the outdoor unit of an existing air conditioner system. The heat exchanger assembly can, for example, comprise the first heat exchanger which may be sized and shaped to substantially overlie an airflow inlet of a condenser.

As noted above, the second heat exchanger can be located within the upper coolant tank of the first heat exchanger such that both heat exchangers are housed within a unitary assembly configured for convenient installation adjacent to the condenser airflow inlet. The heat exchanger assembly can conveniently include both the first and second heat exchangers facilitating installation insofar as only a single component is required for installation at the inlet of the condenser airflow. The heat exchanger assembly can, for example, comprise the pair of upper and lower coolant tanks, the first heat exchanger coolant pipes extending between the pair of coolant tanks and the second heat exchanger located within the upper coolant tank.

The second heat exchanger can consist of a helical tube located within the upper coolant tank, for example a coiled copper tube configured to pass hot refrigerant through the coolant-filled upper coolant tank. The coiled arrangement advantageously increases the surface area exposed to the coolant thereby increasing heat transfer from the refrigerant to the coolant.

The heat exchanger arrangement may comprise a kit configured for retrofitting to an existing air-conditioner system. The kit can be configured to facilitate connection of the first heat exchanger to a condenser air intake of the existing air-conditioner system. The kit may, for example, include brackets, tubes, pipes, fasteners such as bolts or screws, support legs or any other componentry suitable to facilitate installation. Advantageously, the present invention can be readily adapted as an kit to streamline installation thereby reducing costs for end consumers and, moreover, enabling the technology of the present invention to be applied to the large number of existing air-conditioner systems as well as to new installations of air-conditioner systems.

Furthermore, the ability of the present invention to be configured as a kit provides a significant advantage over the prior art systems which are generally not suited for retrofitting to existing devices. By way of example, US2015/0362230 requires installation of a sub-cooler upstream of the evaporator airflow requiring substantial disassembly of an air-conditioner indoor unit and is therefore not adapted for convenient retrofitting to existing systems.

Installation of the present invention may, for example, consist of: locating the heat exchanger assembly at the airflow inlet of an air-conditioner outdoor unit such that the first heat exchanger substantially overlies the inlet; installing the collector arrangement to divert the evaporate condensate into a conduit from the collector arrangement to the lower tank of the heat exchanger assembly; diverting the refrigerant circuit between the condenser and expansion device such that the condenser refrigerant outlet is connected to an inlet port on the upper tank of the heat exchanger assembly and connecting the expansion device to an outlet port on the upper tank of the heat exchanger assembly (i.e. introducing the second heat exchanger between the condenser and the expansion device). The final steps of an installation procedure may comprise filling the heat exchanger arrangement with water from an external water supply and pressure testing the system to check the various connections.

It will be appreciated that the present invention can also relate to an air-conditioner system which includes any of the above-discussed embodiments of the heat exchanger arrangement.

According to another aspect of the invention there is provided a method of improving the efficiency of an air-conditioning system comprising a condenser, an expansion device, an evaporator and a compressor connected in a refrigeration circuit filled with refrigerant, the method comprising the steps of: collecting chilled condensate from the evaporator in a collector arrangement; and guiding the condensate to a first heat exchanger whereby the condensate is used to cool an airflow cooling the condenser; and guiding the condensate to a second heat exchanger whereby the condensate is used to cool refrigerant in the refrigerant circuit and wherein the condensate guided to the second heat exchanger first passes through the first heat exchanger, the second heat exchanger being located within a container associated with, and located at an upper portion of, the first heat exchanger.

A particular embodiment of this aspect the invention includes the additional step of guiding the condensate to a second heat exchanger whereby the condensate is used to cool refrigerant in the refrigerant circuit and wherein the condensate guided to the second heat exchanger first passes through the first heat exchanger. As discussed in the foregoing, this embodiment of the invention advantageously applies the cooling potential of the coolant firstly and primarily to the cooling of the ambient temperature airflow into the condenser. In this manner, the temperature of coolant entering the first heat exchanger is not affected by the operation of the second heat exchanger and the cooling effects on the incoming condenser airflow are maximised so as to provide the greatest overall improvement in system efficiency.

This aspect of the invention may include a step of installing the heat exchanger at an airflow inlet of a condenser associated with an existing air-conditioning system. The present invention may include the step of guiding condensate to a waste outlet after receiving heat from the first heat exchanger. In a particular embodiment, a portion of condensate flow is recirculated through the first or second heat exchangers before being guided to the waste outlet. The amount of recirculated condensate can vary. However, according to a particular embodiment, the portion of recirculated condensate is less than 10% and, more particularly, less than 5% of the condensate volumetric flow rate through the first heat exchanger.

As noted above, in a particular embodiment of the invention, the elongate pipes of the first heat exchanger are formed from copper. The upper and lower coolant tanks may be, in some embodiments formed from copper or in alternative embodiments form from other materials such as stainless steel. In a particular form of the invention, the plurality of elongate pipes and the lower coolant tank is formed form copper whilst the upper coolant tank is formed from stainless steel. Advantageously, each of these materials are recyclable and environmentally friendly. In this regard, at the end of product's life-cycle the materials may be recovered and reused for other purposes. It will be appreciated that a variety of materials may be suitable for use with the present invention and may be selected by a person skilled in the art per the requirements of a particular installation.

According to another aspect of the invention there is provided an improved air-conditioning system comprising: a condenser; an expansion device; an evaporator; and a compressor; wherein the condenser, expansion device, evaporator, and compressor are connected in fluid communication in a refrigeration circuit filled with refrigerant; and wherein the improved air-conditioning system further includes a heat exchanger arrangement comprising a first heat exchanger, the first heat exchanger being configured for facilitating the transfer of heat from an air flow flowing towards the condenser to condensate fluid received from the evaporator wherein the heat exchanger arrangement comprises a second heat exchanger configured for facilitating the transfer of heat from refrigerant to condensate received from the evaporator and wherein the second heat exchanger is located within a container associated with, and located at an upper portion of, the first heat exchanger.

In one embodiment, the heat exchanger arrangement further comprises a collector arrangement for collecting condensate fluid that has condensed on the evaporator as condensate fluid.

In one embodiment, the improved air-conditioning system comprises a conduit for conveying condensate fluid from the evaporator.

In one embodiment, the improved air-conditioning system comprises a pump for pumping condensate fluid from the evaporator to the first heat exchanger.

In one embodiment, the heat exchanger arrangement comprises a second heat exchanger.

In one embodiment, the second heat exchanger is configured for facilitating the transfer of heat from refrigerant received from the compressor to condensate received from the evaporator.

In one embodiment, the second heat exchanger is configured for facilitating the transfer of heat from refrigerant received from the condenser to condensate received from the evaporator.

In one embodiment, the second heat exchanger is configured for receiving refrigerant from one or more selected from the compressor and the condenser.

In one embodiment, the improved air-conditioning system comprises a conduit for conveying refrigerant from the compressor to the second heat exchanger.

In one embodiment, the improved air-conditioning system comprises a conduit for conveying refrigerant from the condenser to the second heat exchanger.

In one embodiment, the second heat exchanger is located within a container associated with the first heat exchanger.

In one embodiment, the second heat exchanger is located within a container located above the first heat exchanger.

In one embodiment, the first heat exchanger comprises a plurality of elongate pipes.

In one embodiment, the first heat exchanger comprises a pair of primary coolant tanks and at least one or more elongate pipes extending between the primary coolant tanks.

In one embodiment, the second heat exchanger comprises a coiled pipe.

In one embodiment, the second heat exchanger comprises a coiled pipe located within a primary coolant tank.

In one embodiment, the second heat exchanger comprises a coiled pipe located within a secondary coolant tank.

In one embodiment, the improved air-conditioning system comprises a conveying conduit for conveying coolant from the first heat exchanger to the secondary coolant tank.

In one embodiment, the improved air-conditioning system comprises at least one valve located along the conveying conduit.

In one embodiment, at least one valve located along the conveying conduit is a non-return valve.

In one embodiment, the coiled pipe extends into at least one or more of the coolant tanks.

In one embodiment, the improved air-conditioning system comprises a fan configured for moving air over the first heat exchanger towards the condenser.

In one embodiment, the improved air-conditioning system comprises a third heat exchanger.

In one embodiment, the improved air-conditioning system is configured for receiving water from a municipal water supply and through the third heat exchanger.

In one embodiment, the third heat exchanger is configured for facilitating the transfer of heat from the coolant to the municipal water supply.

In one embodiment, the third heat exchanger is configured for guiding water from the third heat exchanger to supply heated water to premises.

In a further aspect, the invention may be said to consist in a heat exchanger arrangement for use with an air conditioning system comprising a condenser, an expansion device, an evaporator and a compressor connected in a refrigeration circuit filled with refrigerant, the heat exchanger arrangement comprising: a collector arrangement for collecting condensate fluid that has condensed on the evaporator as condensate fluid; and a first heat exchanger, the first heat exchanger being configured for facilitating the transfer of heat from an air flow flowing to the condenser, to condensate received from the evaporator.

In one embodiment, the heat exchanger arrangement further comprises a collector arrangement for collecting condensate fluid that has condensed on the evaporator as condensate fluid.

In one embodiment, the coolant reservoir is configured for receiving coolant as a condensate from the evaporator.

In one embodiment, the heat exchanger arrangement comprises a conduit for conveying condensate fluid from the evaporator.

In one embodiment, the heat exchanger arrangement comprises a pump for pumping condensate fluid from the evaporator to the first heat exchanger.

In one embodiment, the heat exchanger arrangement is configured for guiding the flow of fluid from the first heat exchanger to the second heat exchanger.

In one embodiment, the second heat exchanger is disposed at a vertically higher level than the first heat exchanger.

In one embodiment, the condenser comprises a fan arrangement and a heat exchanger, and the first heat exchanger is configured for insertion between the fan arrangement and the condenser.

In one embodiment, the heat exchanger arrangement comprises a second heat exchanger.

In one embodiment, the second heat exchanger is configured for facilitating the transfer of heat from refrigerant received from the compressor to condensate received from the evaporator.

In one embodiment, the second heat exchanger is configured for facilitating the transfer of heat from refrigerant received from the condenser to condensate received from the evaporator.

In one embodiment, the second heat exchanger is configured for receiving refrigerant from one or more selected from the compressor and the condenser.

In one embodiment, the improved air-conditioning system comprises a conduit for conveying refrigerant from the compressor to the second heat exchanger.

In one embodiment, the improved air-conditioning system comprises a conduit for conveying heated refrigerant from the condenser to the second heat exchanger.

In one embodiment, the second heat exchanger is located within a container associated with the first heat exchanger.

In one embodiment, the second heat exchanger is located within a container located above the first heat exchanger.

In one embodiment, the first heat exchanger comprises a plurality of elongate pipes.

In one embodiment, the first heat exchanger comprises a pair of primary coolant tanks and at least one or more elongate pipes extending between the primary coolant tanks.

In one embodiment, the second heat exchanger comprises a coiled pipe.

In one embodiment, the second heat exchanger comprises a coiled pipe located within a primary coolant tank.

In one embodiment, the second heat exchanger comprises a coiled pipe located within a secondary coolant tank.

In one embodiment, the improved air-conditioning system comprises a conveying conduit for conveying coolant from the first heat exchanger to the secondary coolant tank.

In one embodiment, the improved air-conditioning system comprises at least one valve located along the conveying conduit.

In one embodiment, the at least one valve located along the conveying conduit is a non-return valve.

In one embodiment, the coiled pipe extends into at least one or more of the coolant tanks.

In one embodiment, the improved air-conditioning system comprises a fan configured for moving air over the first heat exchanger towards the condenser.

In one embodiment, the improved air-conditioning system comprises a third heat exchanger.

In one embodiment, the improved air-conditioning system is configured for receiving water from a municipal water supply and through the third heat exchanger.

In one embodiment, the third heat exchanger is configured for facilitating the transfer of heat from the coolant to the municipal water supply.

In one embodiment, the third heat exchanger is configured for guiding water from the third heat exchanger to supply heated water to premises.

In a further aspect, the invention may be said to consist in an air-conditioning system comprising a heat exchanger arrangement as described.

In a further aspect, the invention may be said to consist in a control system for an air-conditioning system as described, the control system comprising; a controller configured for controlling operation of a heating element of a heat exchanger arrangement as described.

In one embodiment, the controller is configured for controlling operation of a pump configured for pumping condensate from the evaporator to the primary coolant tanks.

In one embodiment, the controller is configured for controlling operation of a pump in response to signals received from a level sensor.

In one embodiment, the level sensor is configured to sense the level of the water in the conduit from a collector to a primary coolant tank.

In one embodiment, the controller is configured for controlling operation of at least one valve.

In one embodiment, the valve is configured to control flow of fluid from a primary coolant tank to a secondary coolant tank.

In one embodiment, the valve is configured to control flow of fluid from a primary coolant tank to the environment.

In a further aspect, the invention may be said to consist in a method of improving the efficiency of an air-conditioning system comprising a condenser, an expansion device, an evaporator and a compressor connected in a refrigeration circuit filled with refrigerant, the method comprising the steps of; collecting chills condensate from the evaporator in a collector arrangement; and guiding the condensate to a first heat exchanger whereby the condensate is used to cool an airflow cooling the condenser.

In one embodiment, the method comprises the step of guiding the condensate to a second heat exchanger whereby the condensate is used cool refrigerant from one or more selected from a compressor and a condenser.

In one embodiment, the method comprises the step of guiding the condensate to a third heat exchanger whereby the condensate is used to heat water from a municipal water supply.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF DRAWINGS

Notwithstanding any other forms which may fall within the scope of the present invention, a preferred embodiments of the invention will now be described, by way of example only, with reference to the accompanying drawings in which.

DETAILED DESCRIPTION

Figure 1:
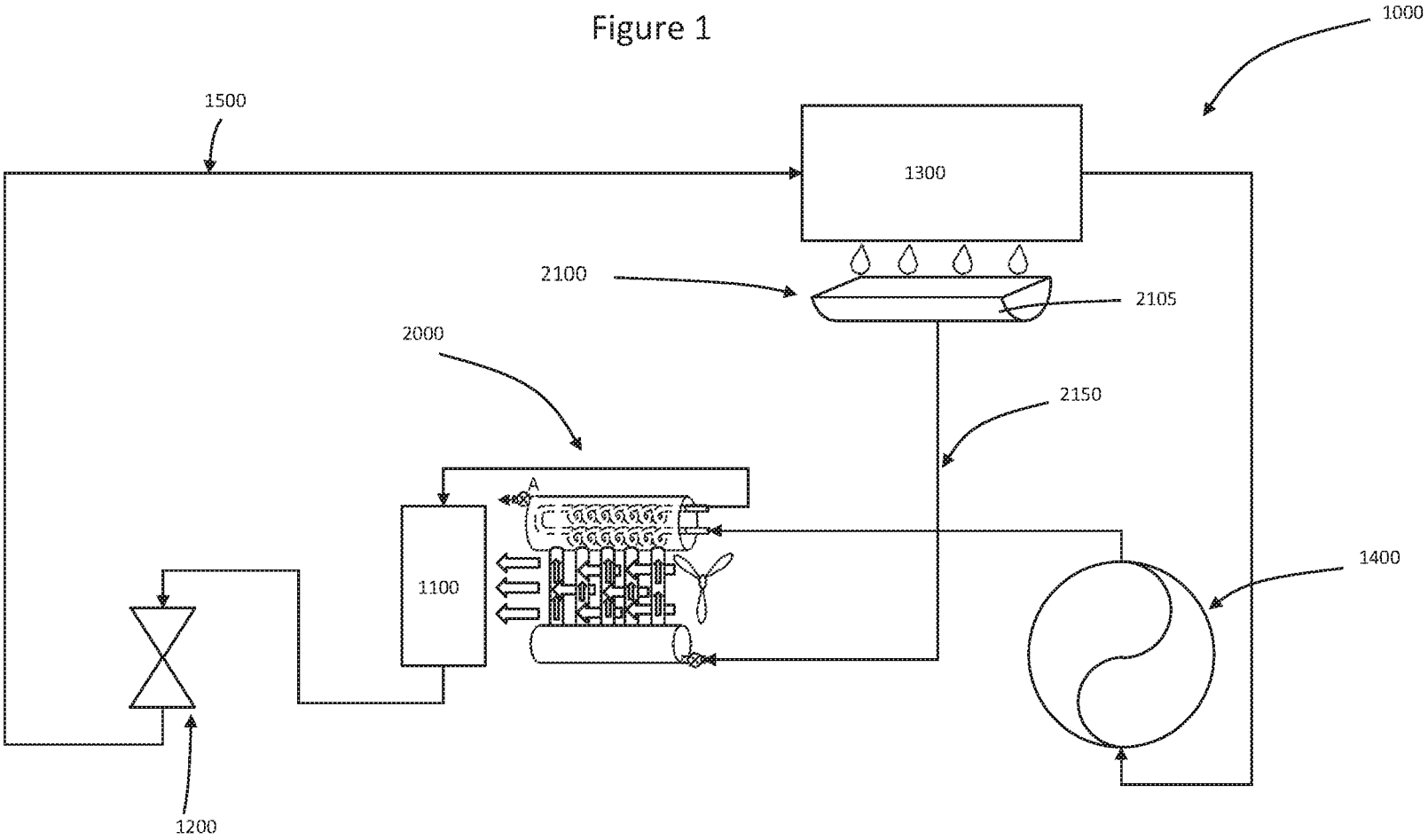
FIG. 1 shows a schematic view of a first embodiment of an improved air-conditioning system and a first embodiment of a heat exchanger arrangement, with the refrigerant being cooled by the second heat exchanger on exit from the compressor.

With reference to the above drawings, in which similar features are generally indicated by similar numerals, an improved air-conditioning system according to a first aspect of the invention is generally indicated by the numeral 1000, and a heat exchanger arrangement is generally indicated by the numeral 2000.

In one embodiment now described, there is provided an improved air-conditioning system 1000 that comprises a heat exchanger arrangement 2000. The air-conditioning system 1000 comprises a condenser 1100 cooled by a condenser fan 1110, an expansion device 1200 such as an expansion valve, an evaporator 1300 and a compressor 1400. The condenser 1100, expansion device 1200, evaporator 1300 and compressor 1400 connected in fluid communication in a refrigeration circuit 1500 that is filled with refrigerant. The condenser 1100 is cooled by airflow created by a condenser fan 1110.

The heat exchanger arrangement 2000 comprises a collector arrangement 2100, a condensate conduit 2150 and a first heat exchanger 2200. The collector arrangement 2100 is preferably a trough 2105 that is configured for collecting condensate that has condensed on the evaporator 1300 as chilled condensate fluid, and the condensate conduit 2150 is configured for guiding the collected condensate to the first heat exchanger 2200.

The first heat exchanger 2200 preferably comprises a pair of primary coolant tanks 2210 in which the collected condensate is received. The primary coolant tank 2210 are in fluid communication with each other via a plurality of heat exchanger tubes 2220. The chilled condensate fluid is received into an inlet 2212 in the lower primary coolant tank 2210*a* shown as arrow B in the figures.

The first heat exchanger 2200 is located in the airflow created by the condenser fan 1110, so that it cools the airflow (shown as arrows A in FIGS. 2, 3 and 6) flowing towards the condenser 1100, thereby facilitating the transfer of heat from the airflow A to the condensate fluid received from the evaporator, thereby heating the condensate fluid. In this way, the chilled condensate fluid is used to cool the airflow flowing towards the condenser 1100.

It is envisaged that where the condenser fan 1110 is blowing the airflow A towards the condenser, then the first heat exchanger 2200 will be located between the condenser fan 1110 and the condenser 1100. However, where the condenser fan is pulling air through the condenser 1100, then the first heat exchanger 2200 will be located on an opposed side of the condenser from the condenser fan 1110. In instances where the condenser fan is located between the condenser and the airflow inlet (i.e. pulling air from the inlet and pushing air toward the condenser) the first heat exchanger 2200 will be located on the opposite side of the condenser fan from the condenser. In any configuration, it will be appreciated that the first heat exchanger will be located in the airflow inlet so as to cool the incoming air before contacting the condenser.

By cooling the airflow A the temperature differential (i.e. drop) of the refrigerant in the refrigerant circuit across the condenser is increased, which allows for increased efficiency is in the air conditioning system.

Figure 7:
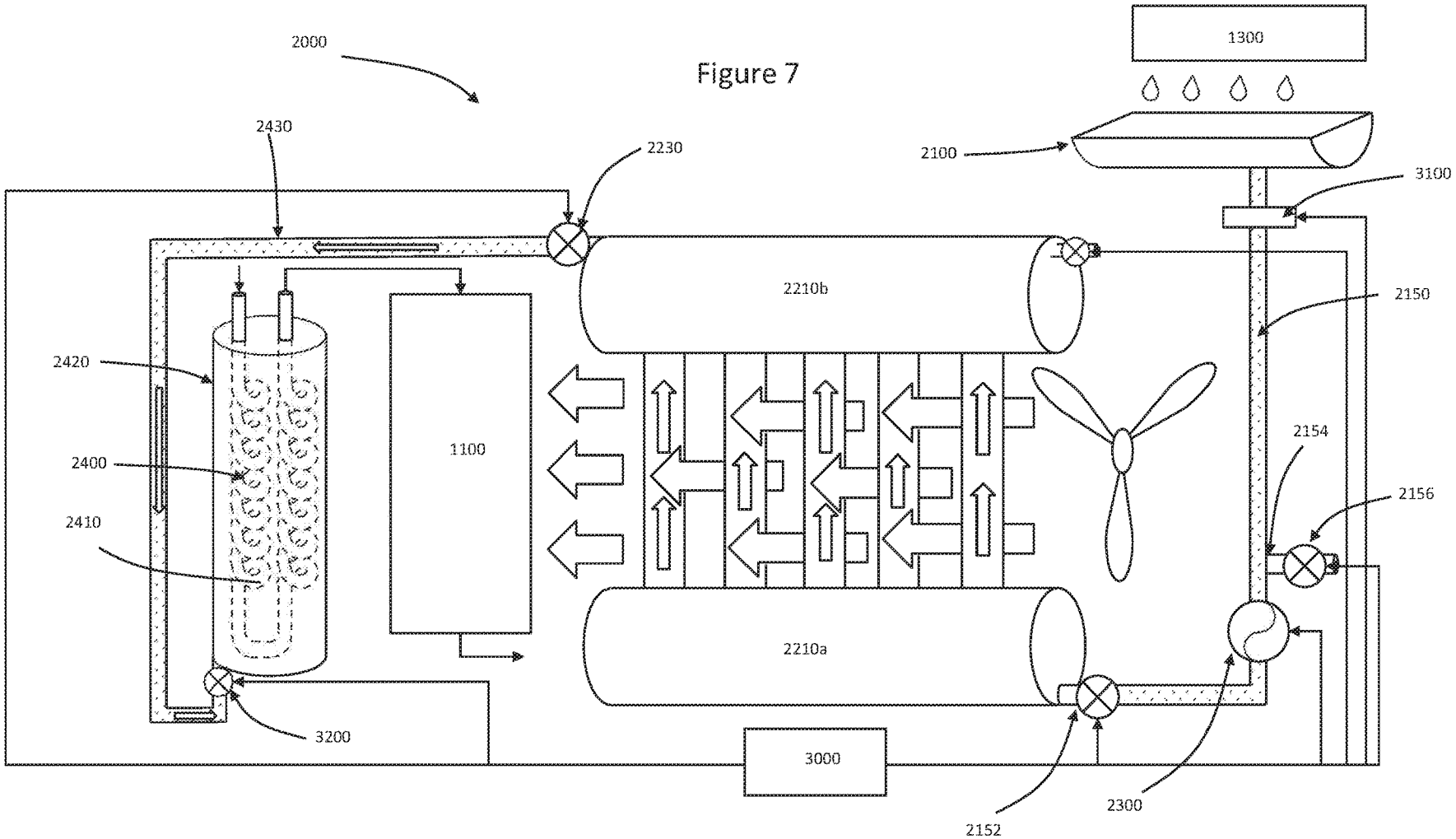
FIG. 7 shows a perspective view of a third embodiment of a heat exchanger arrangement showing a secondary coolant tank in which the second heat exchanger is located.

It is envisaged that the evaporator will be typically located higher up than the condenser (for example high up on a wall), allowing for a significant head of condensate fluid to be built up, and creating a steady flow of condensate fluid from the evaporator to the first heat exchanger 2200 via the condensate conduit 2150. However, in cases where the evaporator 1300 is not located sufficiently elevated from the condenser 1100, or the drag within the condensate conduit 2150 is too high for the pressure created by the head of the condensate to overcome, it is envisaged that the heat exchanger arrangement 1000 can be provided with a coolant pump 2300 (as shown in FIG. 7). The coolant pump 2300 can be controlled by a control system 3000 that ensures that condensate is pumped towards the first heat exchanger when the condensate liquid reaches a certain height, as may be indicated by a level sensor 3100.

It is envisaged that the control system 3000 can further be configured to control a condensate flow valve 2152 along the condensate conduit 2150, as well as an overflow valve 2230 from the primary coolant tanks 2210.

The first heat exchanger 2200 includes a plurality of coolant passageways comprising a plurality of elongate copper tubes 2220. As condensate flows into the first heat exchanger 2200 it will fill up the lower primary coolant tank 2210*a*, the heat exchanger tubes 2220, and the upper primary coolant tank 2210*b*. Once the first heat exchanger 2200 is full, in use, condensate fluid that is in the heat exchanger tubes 2220 will be heated up by heat transfer from the airflow A passing over the heat exchanger tubes 2220. Heat exchanger tubes 2220 therefore define a cooling surface which contacts incoming airflow A and cools airflow A prior to entering the condenser.

The heated condensate fluid will rise (shown as arrow Y in FIG. 3) towards the upper primary coolant tank 2210*b*. The airflow A in turn is cooled before it engages the condenser, reducing the condensing temperature, and in turn decreasing the compressor discharge pressure, which in turn considerably diminishes the electricity usage of the compressor.

Condensate fluid or coolant that has flowed into the upper primary coolant tank 2210*b* can then either be allowed to flow to the environment via a coolant outlet comprising an overflow valve 2230 (shown as arrow E in FIG. 3), or it can be utilised in a second heat exchanger 2400. The second heat exchanger 2400 is configured for facilitating the transfer of heat from refrigerant in the refrigeration circuit 1500 to the condensate as a coolant. In this regard, it is envisaged that the second heat exchanger 2400 can operate in two different embodiments.

Figure 5:
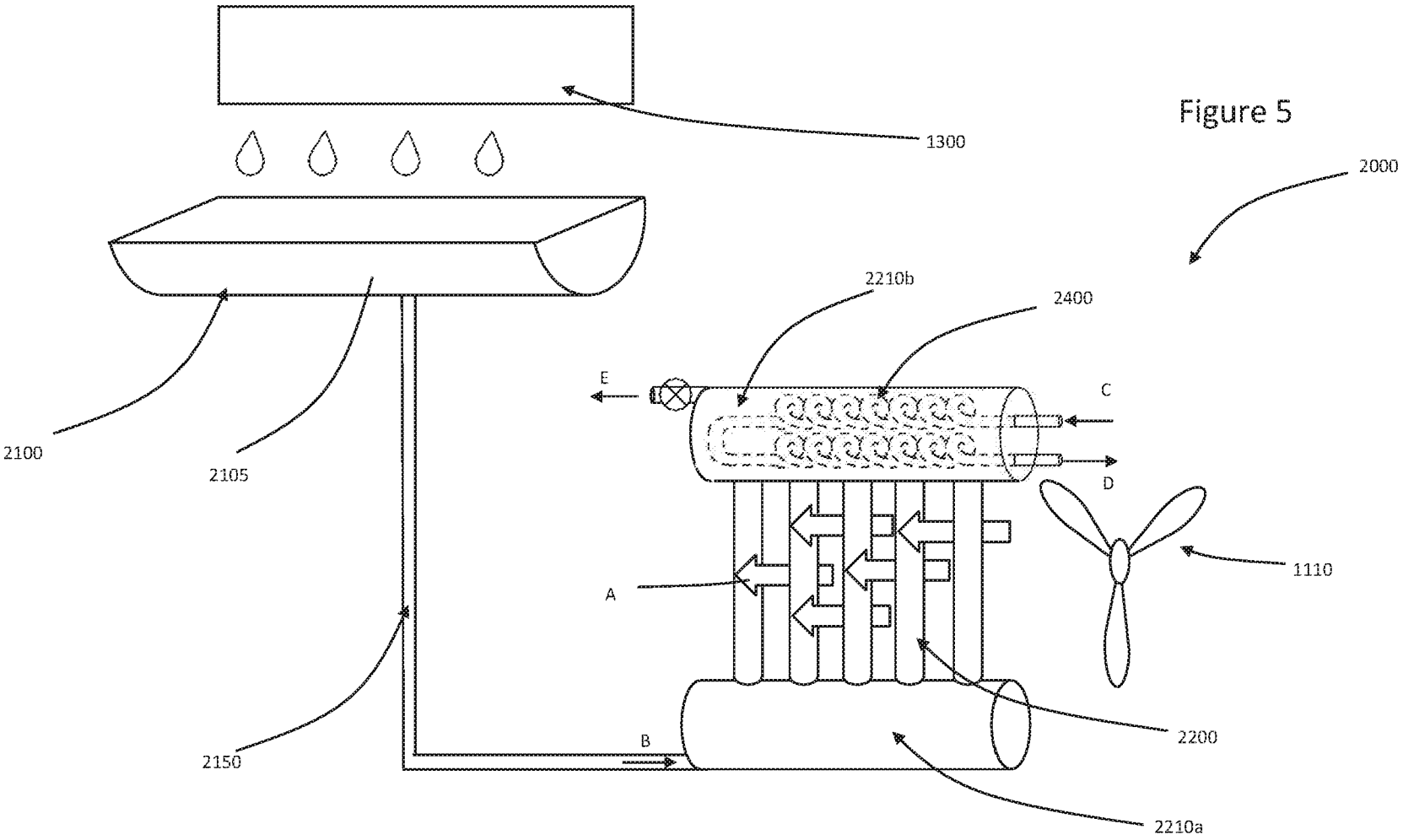
FIG. 5 shows a perspective view of a first embodiment of a heat exchanger arrangement.

In a first embodiment, it is envisaged that heated refrigerant will be received into the second heat exchanger 2400 via a conduit (shown as arrow C in FIGS. 3, 5, 6) by the second heat exchanger 2400 at a relatively high temperature from the compressor 1400. This embodiment is shown in FIG. 1. In this regard, the collector arrangement 2100, first heat exchanger 2200, second heat exchanger 2400 and outflow valve 2230 are connected in fluid communication via a coolant pathway which extends from collector arrangement 2100, along condensate conduit 2150 and from lower tank 2210*a*, through pipes 2200, through upper tank 2210*b* and through overflow valve 2230.

Figure 2:
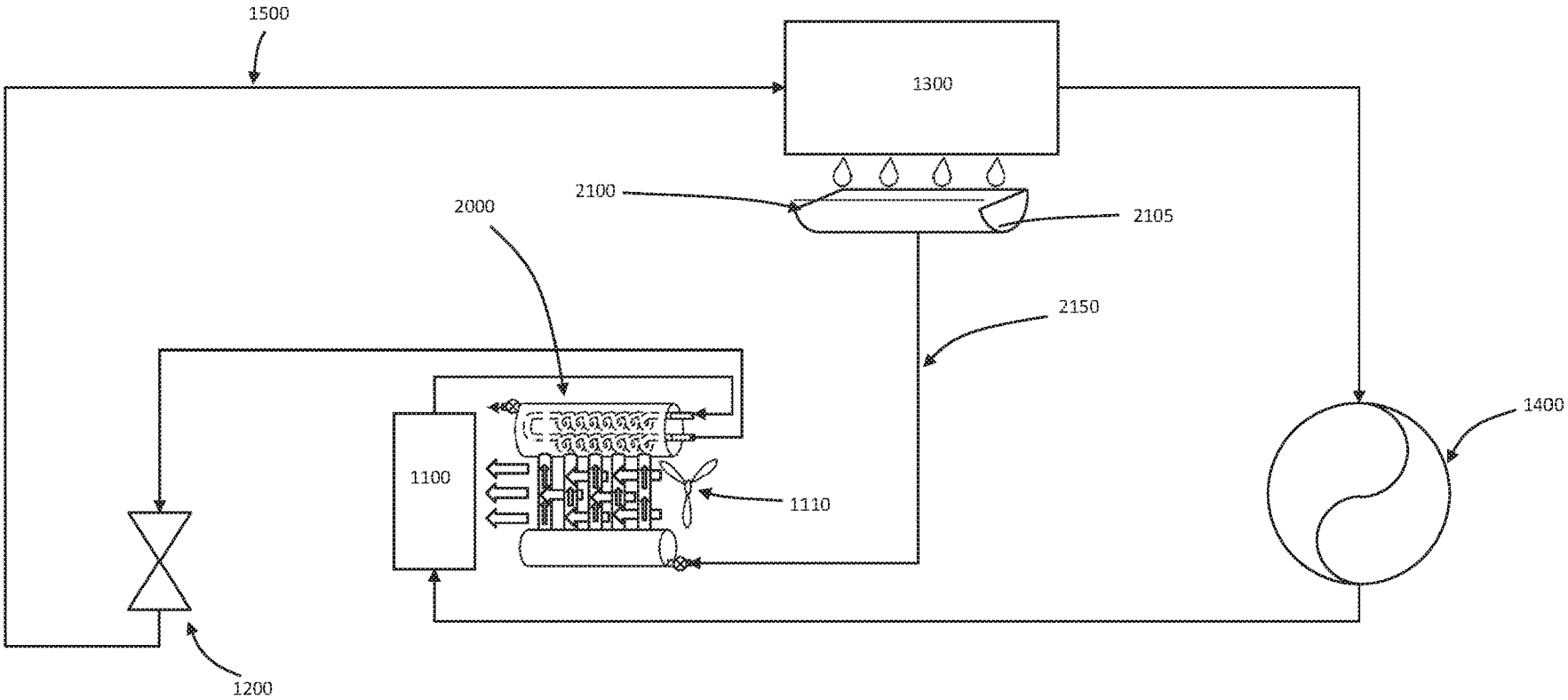
FIG. 2 shows a schematic view of a second embodiment of an improved air-conditioning system and a first embodiment of a heat exchanger arrangement, with the refrigerant being cooled by the second heat exchanger on exit from the condenser.
Figure 3:
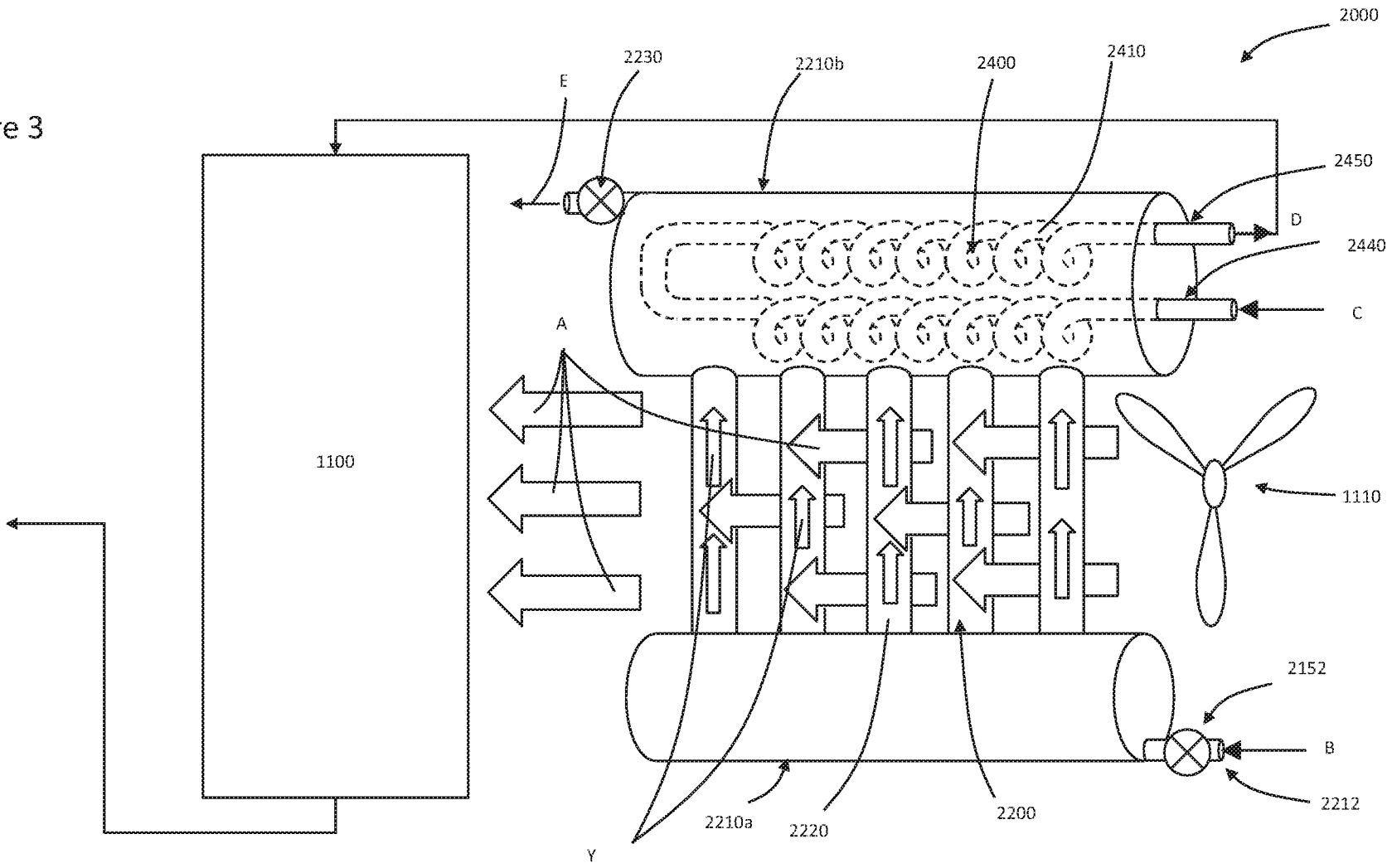
FIG. 3 shows a close up schematic view of a first embodiment of an improved air-conditioning system of FIG. 1 showing a first embodiment of a heat exchanger arrangement and a condenser.
Figure 4:
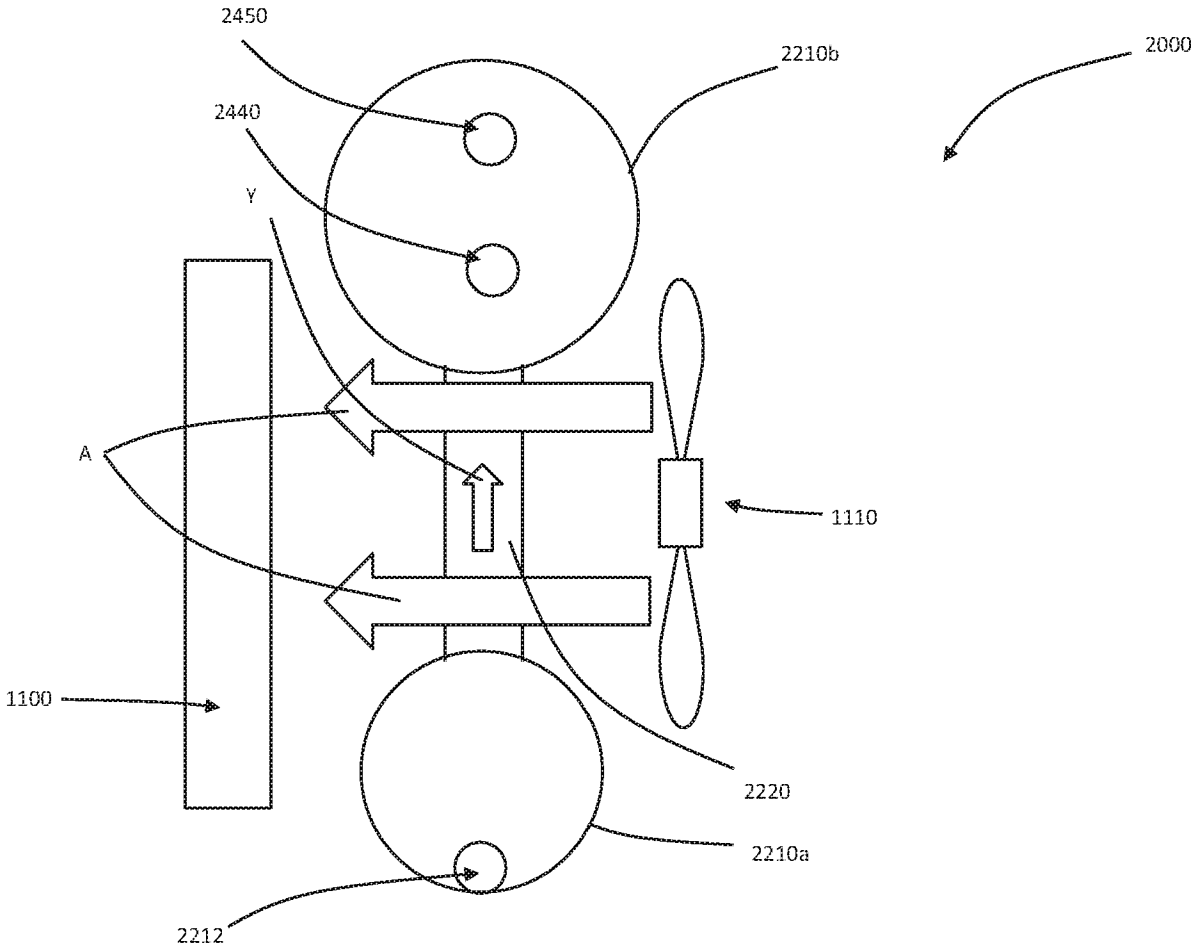
FIG. 4 shows a schematic side view of a first embodiment of a heat exchanger arrangement, a condenser fan and a condenser illustrating their relative layout.

In a second embodiment shown in FIG. 2, it is envisaged that the refrigerant will be received into the second heat exchanger 2400 at inlet 2440 (also shown as arrow C in the figures) via a conduit by the second heat exchanger 2400 at a relatively lower temperature from the condenser 1100. This embodiment is shown in FIG. 2.

As illustrated, the coolant pathway includes an 'open-loop' configuration whereby none of the condensate is recirculated through the heat exchangers, i.e. all of the condensate entering the first heat exchanger 2200 is 'fresh' coolant provided from the collector arrangement 2100. Moreover, the coolant pathway is configured such that all of the coolant collected by collector arrangement 2100 is provided to the first heat exchanger 2200. The first heat exchanger 2200 is also positioned directly downstream of the collector arrangement 2100 i.e. condensate conduit 2150 extends directly between the collector arrangement 2100 and the lower tank 2210*a* of the first heat exchanger 2200. In this regard there are no intermediary components located upstream of the first heat exchanger which may act to warm the condensate supplied to first heat exchanger 2200 (other than unavoidable warming which can occur during passage along condensate conduit 2150).

The refrigerant will pass through the second heat exchanger 2400 and exit the second heat exchanger 2400 at outlet 2450 (shown as arrow D in the figures).

As noted in the foregoing, the second heat exchanger can be connected upstream of the condenser (i.e. between the compressor and condenser) or downstream of the condenser (i.e. between the condenser and expander device). In some instances, either alternative may provide similar results. In other instances, the installer may opt for one alternative over the other depending on the type of air conditioning system being used. By way of example, where an air-conditioning system includes a condenser fan that is control by an inverter, the speed of the condenser fan will increase or decrease depending on the temperature of the refrigerant supplied to the condenser. In this instance, it may be appropriate to connect the second heat exchanger either upstream or downstream of the condenser because the inverter is capable of controlling fan speed to achieve an optimum cooling effect.

In alternative systems where an inverter is not present, the condenser fan is typically configured to switch on at a threshold refrigerant temperature and switch off of the refrigerant supplied to the condenser drops below the threshold temperature. In this instance, connecting the second heat exchanger upstream of the condenser could reduce the refrigerant temperature below the trigger temperature causing the condenser fan to cut off thereby having the effect of terminating or reducing airflow over the first heat exchanger and reducing the advantages provided by the present invention. Accordingly, where the condenser fan is not controlled by an inverter arrangement, it may be desirable to connect the second heat exchanger downstream of the condenser so as not to undesirably trigger condenser fan cut-off.

Two embodiments of a second heat exchanger are shown in the accompanying figures. A first embodiment is shown in FIGS. 1, 2, 3, 5 and 6, the second heat exchanger 2400 comprises a coiled pipe 2410 of preferably heat conductive material that extends into and is received within the upper primary coolant tank 2210*b*, and which forms a conduit for the refrigerant. Heat is transferred from the relatively hot refrigerant in the coiled pipe 2410 to the relatively cool condensate in the upper primary coolant tank 2210*b*. This embodiment relies on the fact that the heated coolant will rise into the upper primary coolant tank 2210*b*.

A second embodiment is shown in FIG. 7, wherein a secondary storage tank 2420 is provided for the condensate to flow into after it has flowed out of the upper primary coolant tank 2210*b*. The coiled pipe 2410 is located within the secondary storage tank 2420. The primary coolant tanks 2210 and the secondary storage tank 2420 are connected to each other via a conveying conduit 2430. In a preferred embodiment, a control valve 3200, is located along the conveying conduit 2430, and is controllable by the control system 3000. In this embodiment, the coolant liquid used for cooling of the refrigerant in the second heat exchanger 2400 is separated from the coolant liquid used for cooling of the airflow A by the first heat exchanger 2200.

It is further envisaged that the air-conditioning system 1000 can comprise a connection 2154 to a municipal water supply for receiving water from the municipal water supply to top up the coolant in the primary coolant tanks 2210 and/or the secondary coolant tank 2420. The flow of water from the municipal water connection 2154 is preferably controllable by a control valve 2156. The control valve 2156 is also preferably controllable by the control system 3000. It is envisaged that municipal water flow may be used to supplement the flow of condensate on days where humidity is low and condensate flow is subsequently also low.

In alternative embodiments (not shown) it is envisaged that the heat exchanger arrangement 2000 can comprise a separate fan (not shown) configured for moving air over the first heat exchanger towards the condenser.

It is further envisaged that the heat exchanger arrangement can include a drainage outlet (not shown) and drainage closure located at a low point of the primary coolant tank and/or the secondary coolant tank for draining liquid coolant. The drainage closure can be removed from the deck drainage outlet to drain coolant from the primary coolant tanks 2210 and/or the secondary coolant tank 2420, for example for the purposes.

Figure 6:
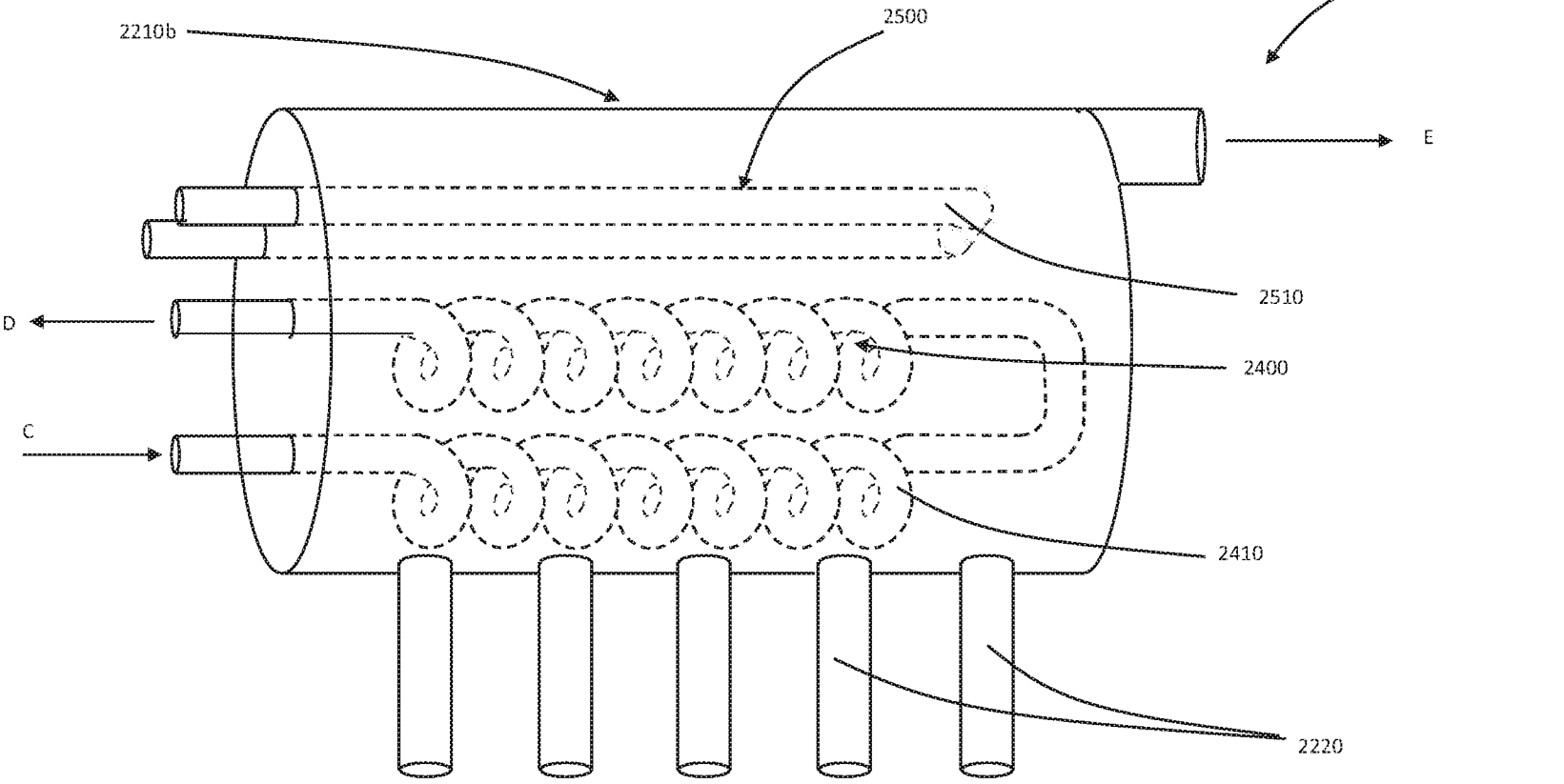
FIG. 6 shows a perspective view of a second embodiment of a heat exchanger arrangement showing a primary coolant tank and portion of a first heat exchanger, with a second heat exchanger and a third heat exchanger located within the primary coolant tank.

In another embodiment shown in FIG. 6, it is envisaged that the improved air-conditioning system 1000 can also comprise a third heat exchanger 2500. It is envisaged that the third heat exchanger will comprise a conductive pipe 2510 that is configured for receiving water from a municipal water supply, and is configured to be heated up by heat transfer from the heated coolant (which in turn has been heated by the heat transfer from the refrigerant). The pre-heated water can then be directed to a premises to increase the efficiency of the water heating at the premises.

It is envisaged that the conductive pipe 2510 of the third heat exchanger can extend into and be received by either the upper primary coolant tank 2210*b* or the secondary storage tank 2420.

It is envisaged that the heat exchanger arrangement 1000 will preferably be retrospectively settable to existing air-conditioning systems, and for this reason it is envisaged that the first heat exchanger will be dimensioned and configured to be inserted into the air flow created by the condenser fan, and mounted there. The heat exchanger arrangement 1000 preferably comprises mounting formations (not shown) for mounting any of the first heat exchanger, and the secondary coolant tanks in place.

Principles of Operation—Thermodynamic Cycle

A single stage vapour compression direct expansion (DX) air-conditioning system typically consists of four major components, namely a rotary scroll compressor, an air cooled condenser, an expansion valve and a DX evaporator. In a conventional system, the cycle starts with a mixture of liquid and vapour refrigerant entering the evaporator. Heat from warm air (for example inside a building) is absorbed by an evaporator DX coil (not shown). During this process, the state of the refrigerant is changed from a liquid to a gas and becomes superheated at the evaporator exit. Super heating is required to prevent slugs of liquid refrigerant from reaching the compressor and causing damage to the compressor.

The superheated vapour then enters the compressor, where it's pressure is increased, thereby also increasing the temperature of the refrigerant, before it flows to the condenser. In conventional vapour compression refrigeration systems, the condensing pressure is designed to allow for condensation of the refrigerant at a high ambient temperature. If the condenser fan is not controlled by an inverter type control arrangement, then energy is wasted in partial load when the ambient temperature is low and a high condensing temperature is not required. By utilising a heat exchanger arrangement 2000 in an improved air-conditioning system 1000 according to the invention, this allows for pre-cooling of the air before it reaches the condenser coil, allowing the condenser to reject more heat. As a result, cooling capacity of the air-conditioning system increases while energy demand and usage fall. As head pressure at the exit of the compressor is lowered, then refrigerant condensing temperatures are reduced. This allows the compressor to use less energy in compressing the refrigerant to a low pressure, and to save energy as it runs for less time in a given air-conditioning period.

The lowering of the temperature of the ambient air before it engages with the condenser coil creates a cooler operating environment for the air cooled condenser which allows the condenser to reject additional heat to the atmosphere. In turn, the compressor head pressure is reduced, for example from point (3) to point (b) on FIG. 8.

Further, in conventional systems, the superheated refrigerant would enter the air cooled condenser where a reduction in the refrigerant temperature takes place and causes it to cool down from its superheated state so that the refrigerant is sub cooled as it enters the expansion valve. Sub cooling prevents a flash gas formation before the expansion valve and ensures that the designed evaporator performance range is achieved.

However, by utilising an air-conditioning system 1000 according to the present invention, refrigerant coming from the condenser is received into the second heat exchanger 2400, allowing for the increased sub-cooling of the refrigerant before entering the expansion device. This enhances the system refrigeration effect, and in turn its coefficient of performance, and also enables this air-conditioning system 1000 to deal with higher load demand. This is demonstrated in FIG. 8 by the changing replacing point (1) with point (a) in the refrigeration cycle.

Figure 8:
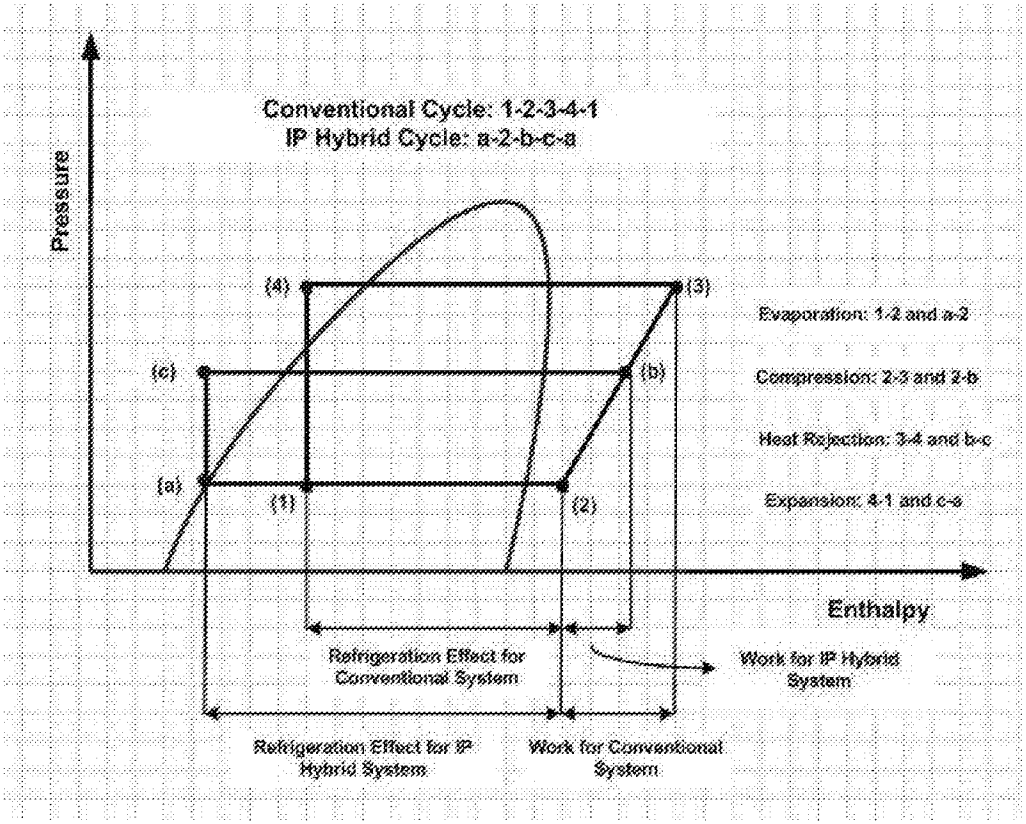
FIG. 8 shows a pressure-enthalpy diagram comparing a conventional air-conditioning system with an air-conditioning system according to the present invention (denoted as the IP Hybrid Cycle).

Accordingly, the high pressure sub cooled refrigerant is allowed to flow through the expansion valve at point (c) of FIG. 8, which serves to reduce its pressure.

Figure 10:
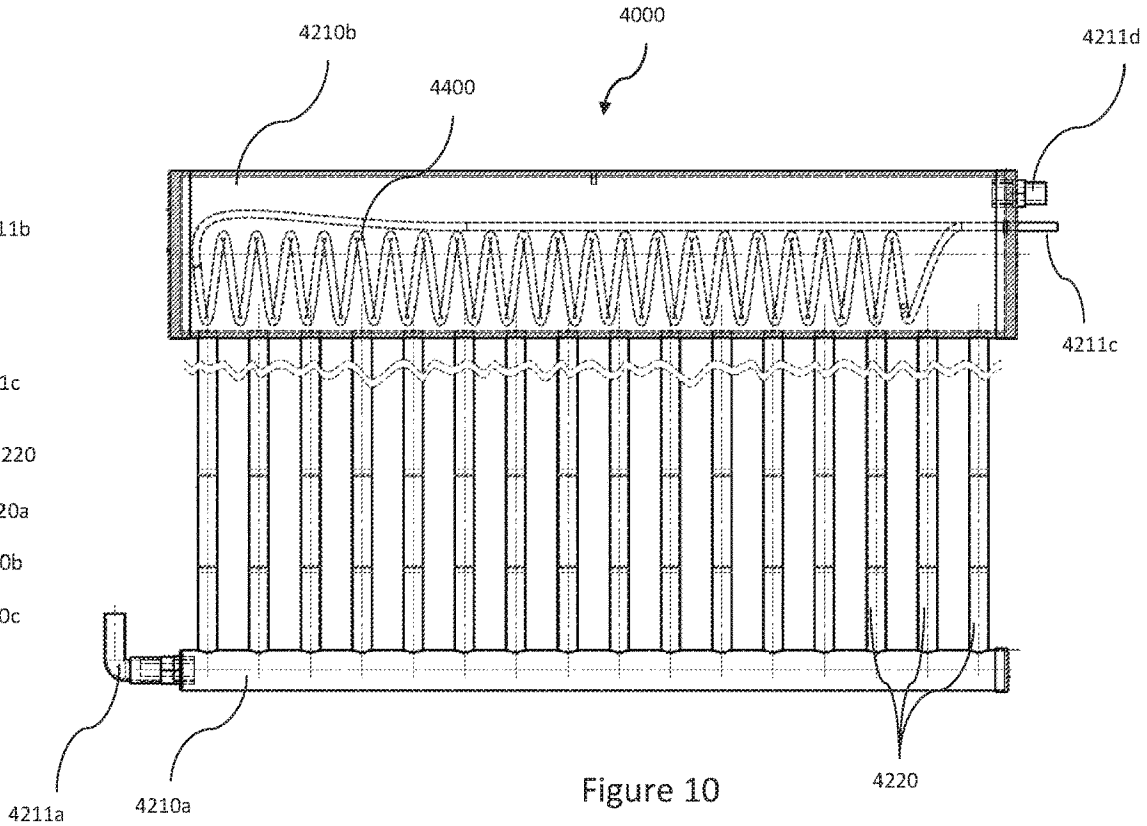
FIG. 10 shows a cross-sectional perspective of the heat exchanger assembly illustrated in FIG. 9
Figure 9:
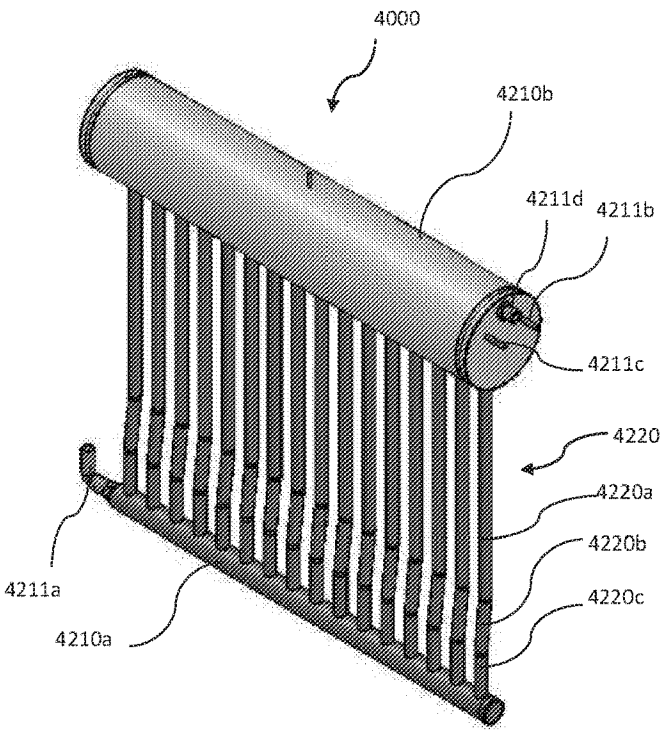
FIG. 9 shows a heat exchanger assembly as part of a heat exchanger arrangement according to a particular embodiment of the present invention.

Turning to FIGS. 9 and 10, there is illustrated a heat exchanger assembly 4000 suitable for convenient retrofitting onto the outdoor unit of an existing air-conditioner system. Heat exchanger assembly 4000 is part of a larger heat exchanger arrangement 2000 (as exemplified in FIGS. 1-3) which also includes a collector arrangement and a conduit for delivering liquid condensate from an evaporator to heat exchanger assembly 4000.

Heat exchanger assembly 4000 includes an upper coolant tank 4210*b* and a lower coolant tank comprising an inlet manifold pipe 4210*a*. As illustrated in FIG. 10, upper coolant tank 4210*b* contains the second heat exchanger which is formed from a copper coil 4400 to facilitate heat transfer from hot refrigerant driven through coil 4400 to the condensate within upper coolant tank 4210*b*.

A plurality of sixteen coolant passageways comprising elongate copper pipes 4220 extend between inlet manifold pipe 4210*a* and upper coolant tank 4210*b*. It will, however, be appreciated that the number of pipes 4220 can and will vary depending on the size of the air conditioner unit intended with use with the heat exchanger assembly 4000. Copper pipes 4220 are adapted by way of their size and shape to substantially overlie the condenser fan airflow inlet on an outdoor unit of an air conditioner unit.

Each elongate pipe 4220 includes a kinked portion 4220*b*, an upper portion 4220*a* located above the kinked portion 4220*b* and a lower portion 4220*c* positioned below the kinked portion 4220*b*. Kinked portion 4220*b* is positioned nearer to the lower coolant tank 4210*a* such that the majority of the length of each pipe 4220 is comprised of the upper portion 4220*a*. Kinked portion 4220*b* is angled relative to the upper and lower portions 4220*a*, 4220*c* so as to offset lower portion 4220*c* from an axis defined by upper portion 4220*a*. Upper and lower portions 4220*a*, 4220*c* are therefore generally parallel but not co-axial. The kinked portions 4220*b* of pipes 4220 offset the lower coolant tank 4210*a* from a plane collective defined by upper portions 4220*a*. This allows for upper portions 4220*a* to be located in desired close proximately to a condenser fan inlet without the lower coolant tank contacting the outdoor unit or obstructing placement of the assembly. In this manner, the provision of kinked portions 4220*b* enables the majority of pipes 4220 to be located more closely to the condenser air inlet therefore facilitating the condenser-cooling provided by the present invention.

Kinks 4220*b* are also advantageous insofar as they enable the upper and lower ends of pipes 4220 to enter the upper and lower tanks 42 in a generally straight orientation as opposed to an angled entry which may otherwise be required in order to provide the desired offset. Straight entry of the pipe ends into the tanks advantageously facilitates welding processes thereby reducing manufacturing cost as well as reducing stress points in the welded connections improving overall robustness.

The lower coolant tank comprised by inlet manifold pipe 4210*a* includes an inlet port 4211*a* for connection to a condensate supply conduit extending from the collector arrangement (not shown). Upper coolant tank 4210*b* includes a pair of ports 4211*b* and 4211*c* which provide inlet and outlet ports for connection to a refrigerant circuit. Upper coolant tank 4210*b* further includes a coolant outlet 4211*d* for expelling waste coolant that has received heat from the first heat exchanger pipes 4220 and the second heat exchanger coil 4400.

It will be appreciated with reference to FIGS. 9 and 10 that the present invention can advantageously provide a unitary heat exchanger assembly enabling convenient installation of the heat exchanger arrangement. The present invention may be provided in a 'kit' which included the heat exchanger assembly, collector arrangement and the necessary piping to connect the coolant pathway. In contrast to previous systems, the first and second heat exchangers of the present invention are conveniently housed within a single component, namely heat exchanger assembly 4000 in FIGS. 9 and 10.

Furthermore, it is noted that by precooling the air before passing the condenser coil and sub cooling the refrigerant before entering the evaporator, the refrigeration effect of the air conditioning system increases. Therefore the compressor will be turned off for longer periods during operation of the air conditioning system than a conventional air conditioning system.

Simulation and Test Data

Mathematical modelling was carried out in order to determine efficiencies achievable by an air conditioning system of the present invention. These simulated actual weather conditions in Sydney, Australia over the year, and theoretical energy savings achievable, together with expected load fulfilment by using an air-conditioning system according to the present invention, and using copper heat exchanger tubes 2220, are shown in Table 1 a and Table 1 b below.

TABLE 1a

Mathematical modelling of energy savings achievable in Sydney

| | Conventional | | | IP Hybrid | | |
|---|---|---|---|---|---|---|
| Month | Compressor [kWh] | Fans [kWh] | Total [kWh] | Compressor [kWh] | Fans [kWh] | Total [kWh] |
| January | 344.3 | 46.8 | 391.1 | 241.4 | 65.7 | 307.1 |
| February | 309.8 | 41.2 | 351 | 223.2 | 59.9 | 283.1 |
| March | 308 | 43.7 | 351.7 | 213.8 | 60.8 | 274.5 |
| April | 0 | 0 | 0 | 0 | 0 | 0 |
| May | 0 | 0 | 0 | 0 | 0 | 0 |
| June | 0 | 0 | 0 | 0 | 0 | 0 |
| July | 0 | 0 | 0 | 0 | 0 | 0 |
| August | 0 | 0 | 0 | 0 | 0 | 0 |
| September | 0 | 0 | 0 | 0 | 0 | 0 |
| October | 0 | 0 | 0 | 0 | 0 | 0 |
| November | 294.8 | 43 | 337.8 | 193.2 | 56.1 | 249.3 |
| December | 319.4 | 42.9 | 362.3 | 224.4 | 60.4 | 284.8 |
| Total | 1,576.20 | 217.7 | 1,793.80 | 1,095.90 | 302.9 | 1,398.80 |
| Average | 131.3 | 18.1 | 149.5 | 91.3 | 25.2 | 116.6 |

TABLE 1b

Mathematical modelling of expected load fulfilment in Sydney

| Load fulfilment | Conventional (reference) | IP Hybrid |
|---|---|---|
| % of time: | 100 | 100 |
| % of energy: | 100 | 100 |
| COP | | |
| Average COP [—]: | 4.27 | 5.2 |
| Energy consumption | | |
| Fans [kWh]: | 218 | 303 |
| Compressor [kWh]: | 1,576 | 1,096 |
| Total [kWh]: | 1,794 | 1,399 |
| Savings | | |
| Yearly energy savings [kWh]: | — | 395 |
| Yearly energy savings [%]: | — | 22 |

In addition, real testing was carried out in Sydney between 20 Dec. 2016 to 12 Feb. 2017. Testing was conducted using an embodiment of the present invention generally illustrated in FIG. 2. That is, the second heat exchanger was connected downstream of the condenser (and upstream of the expander device). The embodiment used was equivalent to the embodiment illustrated in FIGS. 9 and 10. The elongate pipes of the testing apparatus were formed from copper and included a kinked portion. Insulation material was used to cover the lower coolant tank.

Testing involved a 'side-by-side' assessment of two identical 7.1 kW split system Mitsubishi air-conditioning systems. The present invention (termed 'IP Hybrid' or 'Kinetik') was used with one of the air conditioning systems and the other system used as a control. The indoor units of the two air conditioning systems were respectively installed into two adjacent and identical rooms located at the University of Western Sydney. The two outdoor units were located outside the rooms and exposed to the same ambient temperature.

The air-conditioning units were each set to automatically maintain a temperature of 23° C. The air conditioning systems were run 24 hours a day and power consumption of each air conditioning system was recorded every hour, on the hour, so as to compare electricity consumption with and without the use of a heat exchanger arrangement according to the present invention. Power consumption data was also compared against ambient temperature at the time of each power consumption measurement to investigate the effect of ambient temperature on potential power savings.

Particular regard was had to power consumption between the hours of 8 am to 6 pm as these are the peak periods for air conditioner usage when ambient temperature is high. Table 2 below displays average power consumption and ambient temperature at the 11 measurements (i.e. at 8 am, 9 am, 10 am . . . 5 pm, 6 pm). Testing was interrupted on 10 Jan. 2017 and between 20-31 Jan. 2017 and therefore data for these dates is not included below.

TABLE 2

Test results and ambient temperatures of real testing of air conditioning system carried out between 20 Dec. 2016-12 Feb. 2017.

| Time stamp | Conventional (kW) | Kinetik (kW) | Western Syd Uni-Kingswood Campus temperatures (° C.) |
|---|---|---|---|
| 20 Dec. 2016 | 0.94 | 0.63 | 32.29 |
| 21 Dec. 2016 | 0.70 | 0.55 | 28.29 |
| 22 Dec. 2016 | 0.55 | 0.45 | 25.18 |
| 23 Dec. 2016 | 0.65 | 0.51 | 28.18 |
| 24 Dec. 2016 | 0.68 | 0.64 | 28.95 |
| 25 Dec. 2016 | 0.74 | 0.55 | 29.66 |
| 26 Dec. 2016 | 1.02 | 0.65 | 32.75 |
| 27 Dec. 2016 | 0.94 | 0.62 | 31.10 |
| 28 Dec. 2016 | 1.12 | 0.72 | 33.45 |
| 29 Dec. 2016 | 1.24 | 0.74 | 37.59 |
| 30 Dec. 2016 | 0.79 | 0.53 | 32.25 |
| 31 Dec. 2016 | 1.09 | 0.68 | 32.70 |
| 1 Jan. 2017 | 0.64 | 0.57 | 28.25 |
| 2 Jan. 2017 | 0.60 | 0.45 | 24.52 |
| 3 Jan. 2017 | 0.58 | 0.54 | 26.26 |
| 4 Jan. 2017 | 0.62 | 0.52 | 26.66 |
| 5 Jan. 2017 | 0.59 | 0.45 | 24.10 |
| 6 Jan. 2017 | 0.54 | 0.45 | 24.03 |
| 7 Jan. 2017 | 0.68 | 0.68 | 28.90 |
| 8 Jan. 2017 | 0.95 | 0.62 | 31.63 |
| 9 Jan. 2017 | 1.14 | 0.72 | 33.80 |
| 11 Jan. 2017 | 1.27 | 0.84 | 37.59 |
| 12 Jan. 2017 | 0.86 | 0.59 | 30.04 |
| 13 Jan. 2017 | 1.57 | 0.91 | 36.96 |
| 14 Jan. 2017 | 1.13 | 0.65 | 36.18 |
| 15 Jan. 2017 | 0.72 | 0.57 | 28.55 |
| 16 Jan. 2017 | 0.94 | 0.68 | 31.95 |
| 17 Jan. 2017 | 1.50 | 0.87 | 36.47 |
| 18 Jan. 2017 | 1.40 | 0.84 | 21.22 |
| 19 Jan. 2017 | 0.41 | 0.33 | 21.22 |
| 1 Feb. 2017 | 0.36 | 0.39 | 24.85 |
| 2 Feb. 2017 | 0.53 | 0.52 | 27.68 |
| 3 Feb. 2017 | 0.38 | 0.42 | 24.63 |
| 4 Feb. 2017 | 0.73 | 0.61 | 32.63 |
| 5 Feb. 2017 | 0.59 | 0.45 | 38.00 |
| 6 Feb. 2017 | 1.10 | 0.79 | 35.05 |
| 7 Feb. 2017 | 0.33 | 0.37 | 23.87 |
| 8 Feb. 2017 | 0.49 | 0.54 | 26.83 |
| 9 Feb. 2017 | 0.72 | 0.58 | 32.69 |
| 10 Feb. 2017 | 1.63 | 1.04 | 38.94 |
| 11 Feb. 2017 | 1.62 | 1.03 | 39.13 |
| 12 Feb. 2017 | 0.89 | 0.65 | 32.58 |

As illustrated in Table 2, it was observed that on almost every day of testing, the air conditioner system fitted with a 'Kinetik' heat exchanger arrangement according to the present invention was able to maintain the 23° C. set temperature between the hours of 8 am-6 pm, using less power than the identical air conditioner system which wasn't fitted with the present invention.

A sum of total power consumption between the hours of 8 am to 6 pm across the whole experiment is shown and compared in table 3 below along with a comparison of the peak consumption observed across the whole duration of the experiment.

TABLE 3

Comparison of total consumption between 8am-6pm and comparison of highest observed power consumption.

| | Total consumption 8am-6pm | Peak consumption 24 × 7 |
|---|---|---|
| Standard consumption (kWh) | 420 | 2.72 |
| Kinetik consumption (kWh) | 304 | 1.56 |
| Variance (kWh) | 116 | 1.16 |
| Variance (%) | 28% | 43% |

As illustrated in Table 3, it was observed that the present invention provided a 28% reduction in total power consumption between 8 am-6 pm over the course of the testing. It was also observed that the air conditioning system fitted with the heat exchanger arrangement of the present invention drew a peak energy supply 43% lower than the control air conditioning system.

Figure 11:
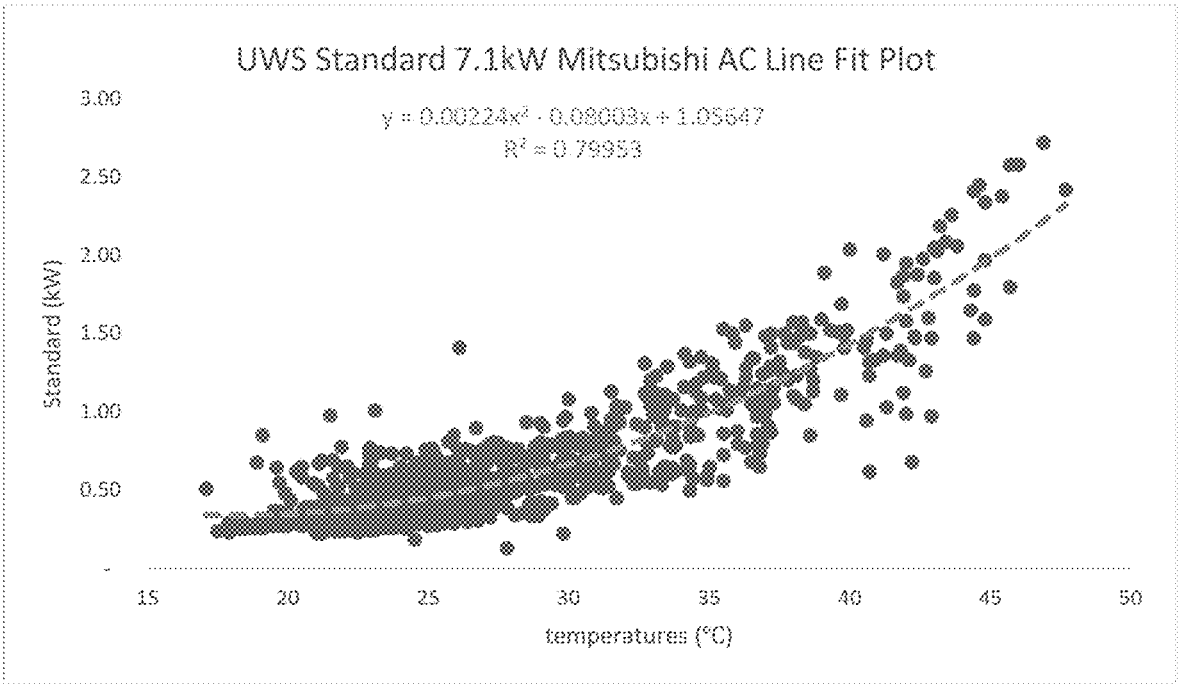
FIG. 11 is a scatter plot of power consumption against ambient temperature for control air-conditioning system.
Figure 12:
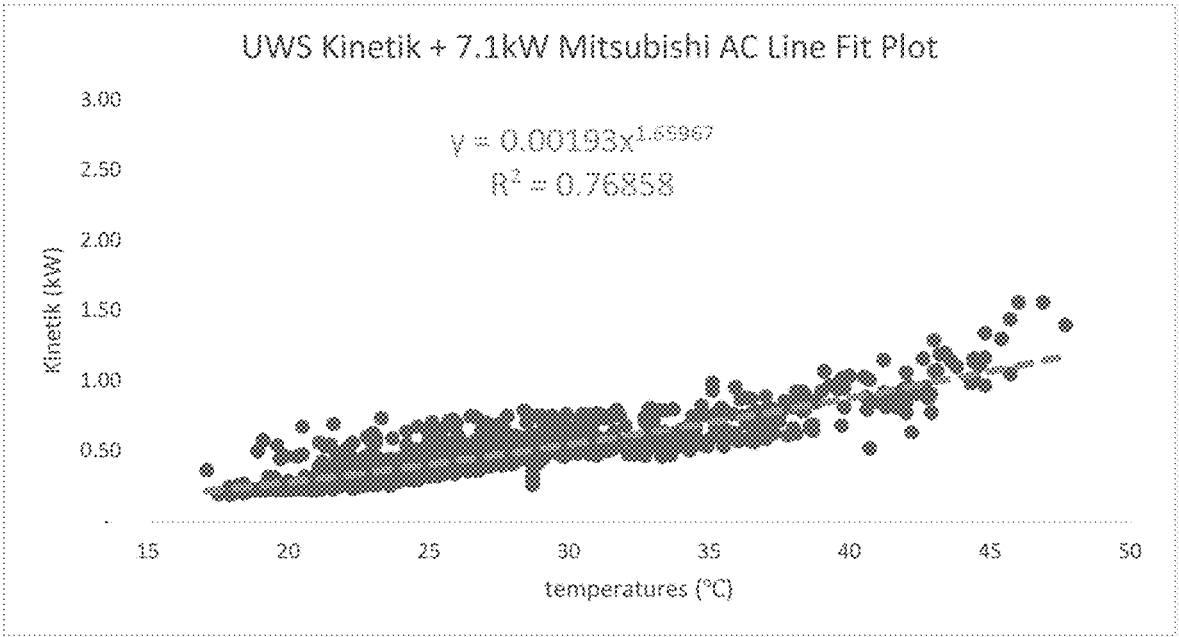
FIG. 12 is a scatter plot of power consumption against ambient temperature for air-conditioning system fitted with 'Kinetik' device according to the present invention.

It was therefore observed that the present invention provided a significant improvement in efficiency which was found to increase with higher ambient temperature. A regression analysis of the measured data was performed to calculate a trend line, as illustrated in FIGS. 11 and 12. FIG. 11 is a scatter plot of power consumption against ambient temperature for control air-conditioning system. FIG. 12 is a scatter plot of power consumption against ambient temperature for air-conditioning system fitted with 'Kinetik' device according to the present invention.

As illustrated in FIGS. 11 and 12, power consumption was observed to increase on days of higher ambient temperature. However the control system was found to increase kW consumption with temperature in a quadratic correlation as shown by the line of best fit in FIG. 11. In contrast, the system fitted the present invention increased kW consumption in a more linear correlation as indicated by the line of best fit shown in FIG. 12. Accordingly, a much larger increase in power consumption was required to maintain the set 23° C. inside temperature when using the control air conditioner system, as ambient temperature increased, as compared to when using the air conditioner system fitted with the present invention. In addition to improving efficiency, the present invention also resulted in a much lower 'peak' energy consumption.

The trend lines indicated in FIGS. 11 and 12 enable a side-by-side comparison of predicted power consumption for each system on a range of ambient temperatures. These are shown below in table 4.

TABLE 4

Regression modelling of power consumption at different ambient temperatures

| | Temperature | | | |
|---|---|---|---|---|
| | 25 | 30 | 35 | 40 |
| Standard | 0.46 | 0.67 | 1.00 | 1.44 |
| Kinetik | 0.40 | 0.55 | 0.71 | 0.88 |
| Variance (kWh for 1 hour) | 0.05 | 0.13 | 0.29 | 0.56 |
| Variance (%) | 11% | 19% | 29% | 39% |

As illustrated in Table 4, the regression analysis modelled an 11% power saving at 25° C. ambient temperature whereas a 39% power saving was modelled where ambient temperature is 40° C. It is further expected by the applicant that efficiencies in regions with increased humidity (for example close to the equator) could achieve even better results.

Interpretation

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the description provided herein, numerous specific details are set forth. However, it is understood that embodiments of the invention may be practiced without these specific details. In other instances, well-known methods, structures and techniques have not been shown in detail in order not to obscure an understanding of this description.

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

For the purposes of this specification, the term "plastic" shall be construed to mean a general term for a wide range of synthetic or semisynthetic polymerization products, and generally consisting of a hydrocarbon-based polymer.

As used herein the term "and/or" means "and" or "or", or both.

As used herein "(s)" following a noun means the plural and/or singular forms of the noun.

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

Finally, it is to be understood that the invention described herein is susceptible to variations, modifications and/or additions other than those specifically described and it is to be understood that the invention includes all such variations, modifications and/or additions which fall within the spirit and scope of the present disclosure.

The invention claimed is:

1. A heat exchanger arrangement for use with an air conditioning system comprising a condenser, au expansion device, an evaporator and a compressor connected in a refrigeration circuit filled with refrigerant, the heat exchanger arrangement comprising: a collector arrangement for collecting condensate fluid that has condensed on the evaporator as condensate fluid; and a first heat exchanger, the first heat exchanger being configured for facilitating the transfer of heat from an airflow flowing to the condenser, to condensate received from the evaporator, wherein the heat exchanger arrangement comprises a second heat exchanger configured for facilitating the transfer of heat from refrigerant to condensate received from the evaporator, and wherein the second heat exchanger is located within a container of condensate which has passed through the first heat exchanger, the container being associated with, and located at an upper portion of, the first heat exchanger.

2. A heat exchanger arrangement according to claim 1 wherein the collector arrangement, the first heat exchanger and a coolant outlet are connected in fluid communication via a coolant pathway, the coolant outlet being located downstream of the first heat exchanger in the coolant pathway for, in use, expelling waste coolant that has received heat from the first heat exchanger.

3. A heat exchanger arrangement according to claim 2, wherein the coolant pathway includes a recirculation loop extending from an inlet downstream of the first heat exchanger to an outlet upstream of the first heat exchanger and whereby, in use, a portion of the condensate supplied to the first heat exchanger is recirculated condensate supplied through the recirculation loop.

4. A beat exchanger arrangement according to claim 3, wherein the recirculation loop is configured to supply a portion of recirculated condensate to the first heat exchanger that is less than 10% of the total volumetric flow of condensate supplied to the first heat exchanger.

5. A heat exchanger arrangement according to claim 2, wherein the coolant pathway comprises an open-loop configuration whereby no portion of the condensate flow is recirculated through the first heat exchanger.

6. A heat exchanger arrangement according to claim 2 wherein the coolant pathway is configured to deliver substantially all condensate collected by the collector arrangement to the first heat exchanger.

7. A heat exchanger arrangement according to claim 2 wherein the coolant pathway is configured to minimise condensate temperature increase between the collector arrangement the first heat exchanger.

8. A heat exchanger arrangement according to claim 2 wherein the coolant pathway is configured such that the first heat exchanger is immediately downstream of the collector arrangement.

9. A heat exchanger arrangement according to claim 1, wherein the heat exchanger arrangement is configured for guiding, the flow of fluid from the first heat exchanger to the second heat exchanger.

10. A heat exchanger arrangement according to claim 2, wherein the second heat exchanger is connected to the coolant pathway downstream of the first heat exchanger and upstream of the coolant outlet.

11. A heat exchanger arrangement according to claim 1 wherein the first heat exchanger includes a plurality of coolant passageways extending between a pair of coolant tanks comprising a lower coolant tank and an upper coolant tank, wherein the second heat exchanger is located within the upper coolant tank and the heat exchanger arrangement further including a conduit for delivering condensate collected from the evaporator to the lower coolant tank.

12. A heat exchanger arrangement according to claim 1, the first heat exchanger comprising a plurality of elongate pipes.

13. A heat exchanger arrangement according to claim 1, wherein the first heat exchanger defines a cooling surface configured to, in use, overlie an airflow inlet on a condenser.

14. A heat exchanger arrangement according to claim 13, wherein the first heat exchanger is configured to, in use, facilitate flow of liquid coolant across the airflow inlet.

15. A heat exchanger arrangement according to claim 1 comprising a kit configured for retrofitting the heat exchanger arrangement to an existing air-conditioner system and the kit being configured to facilitate connection of the first heat exchanger to a condenser air intake of an existing air-conditioner system.

16. A method of improving the efficiency of an air-conditioning system comprising a condenser, an expansion device, an evaporator and a compressor connected in a refrigeration circuit filled with refrigerant, the method comprising the steps of:

a. collecting chilled condensate from the evaporator in a collector arrangement;

b. guiding the condensate to a first heat exchanger whereby the condensate is used to cool an airflow cooling the condenser; and c. guiding, the condensate to a second heat exchanger whereby the condensate is used to cool refrigerant in the refrigerant circuit and wherein the condensate guided to the second heat exchanger first passes through the first heat exchanger, the second heat exchanger being located within a container of condensate which has passed through the first beat exchanger, the container being associated with, and located at an upper portion of, the first heat exchanger.

17. A method according to claim 16 including the step of installing the first heat exchanger at an airflow inlet of the condenser associated with an existing, air-conditioning system.

18. A method according to claim 16 including, the step of guiding condensate to a waste outlet after receiving heat from both the first and second beat exchangers.

19. A method according to claim 18 wherein a portion of condensate flow is recirculated through the first or second heat exchangers before being guided to the waste outlet.

20. An improved air-conditioning system comprising: a condenser; an expansion device; an evaporator; and a compressor, wherein the condenser, expansion device, evaporator, and compressor are connected in fluid communication in a refrigeration circuit filled with refrigerant; and wherein the improved air-conditioning system further includes a heat exchanger arrangement comprising: a first heat exchanger, the first heat exchanger being configured for facilitating the transfer of heat from an air flow flowing towards the condenser to condensate fluid received from the evaporator, wherein the heat exchanger arrangement comprises a second heat exchanger configured for facilitating the transfer of heat from refrigerant to condensate received from the evaporator, and wherein the second heat exchanger is located within a container of condensate which has passed through the first heat exchanger, the container being associated with, and located at an upper portion of, the first heat exchanger.

* * * * *